US012383034B2

(12) United States Patent
Heim et al.

(10) Patent No.: US 12,383,034 B2
(45) Date of Patent: Aug. 12, 2025

(54) POLE HANDLE WITH LOOP FASTENING

(71) Applicant: LEKISPORT AG, Baar (CH)

(72) Inventors: Eberhard Heim, Unterensingen (DE); Wladimir Kreis, Kirchheim (DE)

(73) Assignee: LEKISPORT AG, Baar (CH)

( * ) Notice: Subject to any disclaimer, the term of this patent is extended or adjusted under 35 U.S.C. 154(b) by 171 days.

(21) Appl. No.: 18/005,297

(22) PCT Filed: Jul. 2, 2021

(86) PCT No.: PCT/EP2021/068294
§ 371 (c)(1),
(2) Date: Jan. 12, 2023

(87) PCT Pub. No.: WO2022/012965
PCT Pub. Date: Jan. 20, 2022

(65) Prior Publication Data

US 2023/0255330 A1 Aug. 17, 2023

(30) Foreign Application Priority Data

Jul. 14, 2020 (EP) ..... 20185606
Jul. 14, 2020 (EP) ..... 20185607
(Continued)

(51) Int. Cl.
*A63C 11/22* (2006.01)
*A45B 9/02* (2006.01)

(52) U.S. Cl.
CPC ..... *A63C 11/2228* (2020.08); *A45B 9/02* (2013.01); *A63C 11/2224* (2020.08); *A45B 2009/025* (2013.01); *A45B 2200/055* (2013.01)

(58) Field of Classification Search
CPC ..... A63C 11/2228; A63C 11/2224; A63C 11/227; A45B 9/02; A45B 2009/025; A45B 2200/055
(Continued)

(56) References Cited

U.S. PATENT DOCUMENTS 4,130,293 A * 12/1978 Hinterreiter ..... A63C 11/2224 280/822
6,439,610 B1 * 8/2002 Pronzati ..... A63C 11/2224 24/191
(Continued)

FOREIGN PATENT DOCUMENTS

CN 203105897 U 8/2013
DE 7535934 U 5/1976
(Continued)

OTHER PUBLICATIONS 5 page PDF of English translation of the written opinion mailed Aug. 9, 2021 for PCT/EP2021/068294. (Year: 2021).*
(Continued)

*Primary Examiner* — Robert Canfield
(74) *Attorney, Agent, or Firm* — Sughrue Mion, PLLC

(57) ABSTRACT

A pole handle having a central receiving area that receives a loop fastening element with a hand loop, which is secured to the loop fastening element and has an adjustable size. The loop fastening element and the hand loop is secured to the loop fastening element to form a modular unit which is formed separately from a core of the pole handle and which is secured to the core of the pole handle in a reversibly tiltable manner about a rotational axis in the pole handle. The loop fastening element can be tilted from a rest position, in which the loop fastening element is integrated into the surface contour of the handle head and in which the size of the hand loop cannot be adjusted, upwards about the rota-
(Continued)

tional axis into an adjustment position, in which the size of the hand loop can be adjusted.

29 Claims, 11 Drawing Sheets

(30) Foreign Application Priority Data

Dec. 8, 2020 (EP) ..... 20212352
Dec. 8, 2020 (EP) ..... 20212353

(58) Field of Classification Search
USPC ..... 280/821, 822
See application file for complete search history.

(56) References Cited

U.S. PATENT DOCUMENTS

| | | | | |
|---|---|---|---|---|
| 7,621,564 | B2 * | 11/2009 | Lenhart | A45B 9/02 280/821 |
| 8,714,172 | B2 * | 5/2014 | Heim | A45B 9/02 135/65 |
| D1,032,761 | S * | 6/2024 | Muller | D21/775 |
| 12,096,830 | B2 * | 9/2024 | Lipman | A45B 9/02 |
| 2008/0012286 | A1 * | 1/2008 | Lenhart | A63C 11/2224 24/265 R |
| 2013/0140803 | A1 * | 6/2013 | Roiser | A63C 11/2224 280/821 |
| 2020/0352290 | A1 * | 11/2020 | Heim | A63C 11/2224 |
| 2021/0228972 | A1 * | 7/2021 | Heim | A63C 11/227 |
| 2021/0307463 | A1 * | 10/2021 | Lai | A45B 9/02 |
| 2022/0160086 | A1 * | 5/2022 | Chen | A45B 3/00 |
| 2023/0309667 | A1 * | 10/2023 | Böing | A63C 11/2224 135/65 |
| 2024/0293728 | A1 * | 9/2024 | Morvan | A45B 9/02 |

FOREIGN PATENT DOCUMENTS

| | | | | |
|---|---|---|---|---|
| DE | 29906612 | U1 | 8/2000 | |
| DE | 102006008066 | A1 | 10/2006 | |
| EP | 1053770 | A1 * | 11/2000 | A45B 9/02 |
| EP | 2168641 | A1 | 3/2010 | |
| WO | 2006/060932 | A1 | 6/2006 | |
| WO | 2006/084403 | A1 | 8/2006 | |
| WO | 2018/166854 | A1 | 9/2018 | |

OTHER PUBLICATIONS

International Search Report of PCT/EP2021/068294 dated Aug. 9, 2021 [PCT/ISA/210].

* cited by examiner

POLE HANDLE WITH LOOP FASTENING

CROSS REFERENCE TO RELATED APPLICATIONS

This application is a National Stage of International Application No. PCT/EP2021/068294 filed on Jul. 2, 2021, claiming priority based on European Patent Application No. 20185606.9 filed on Jul. 14, 2020, European Patent Application No. 20212352.7 filed on Dec. 8, 2020, European Patent Application No. 20185607.7 filed on Jul. 14, 2020, and European Patent Application No. 20212353.5 filed on Dec. 8, 2020.

TECHNICAL FIELD

The present invention relates to a pole handle, for example for a hiking pole, a trekking pole, a ski pole or a Nordic walking pole, in which the loop is designed to be adjustable in terms of its length, respectively size. The present invention further relates to a pole with such a pole handle and a method for the assembly of such a pole handle.

PRIOR ART

Pole handles which are gripped by the user from a direction transversely to the pole longitudinal axis are known in the prior art, for example in DE 299 06 612 U1, wherein the contours of the pole handle are configured such that they are suitable for a sequential arrangement of the fingers of the hand of a user. In the case of a force acting from above, a projection serves as a support for the index finger downwardly. A walking pole in which a knob forms the pole handle is disclosed in DE 10 2006 008 066 A1. In this case, the knob is eccentrically positioned on the pole shaft. This pole handle is only suitable for gripping from the top.

Further pole handles having an ergonomic design of the handle head are disclosed in EP-A-2 168 641.

In such handle constructions, the loops can be fastened in an adjustable manner by the use of different mechanisms, see for example EP-A-1 848 298, WO-A-2018/166854, EP-A-1 819 406.

A handle for ski poles is disclosed in DE 7535934U, having a handle to be positioned on the upper end of a ski pole and to be clasped by a hand, and a strap which is connected to said handle at both ends, forming a loop, and which is characterized in that a free end of the strap is releasably fastened to the handle such that it is releasable from the handle when subjected to an upward pulling force relative to the stationary ski pole. In this case, the loop is not clamped but the strap has holes in which a pin positively engages.

SUMMARY OF THE INVENTION

It is accordingly the object of the present invention to provide an improved pole handle of the type mentioned in the introduction.

Specifically, the invention relates to providing a pole handle, in particular for a ski pole, cross-country ski pole, trekking pole or Nordic walking pole, having a head region and a handle region, as well as an axial recess for receiving a pole tube, and a hand loop which is fastened thereto and which is adjustable in terms of its size.

In this case, the pole handle has a central recess in which a loop fastening element with a hand loop, which is fastened to the loop fastening element and which is adjustable in terms of its size, is at least partially received.

In this case, according to the invention the pole handle is characterized in that the loop fastening element and the hand loop, which is fastened to the loop fastening element, form a modular unit which is configured separately from a core of the pole handle and which is fastened to the core of the pole handle in a reversibly tiltable manner about a rotational axis in the pole handle.

In this case, the loop fastening element can be tilted in a resting position X1, in which the loop fastening element is integrated in the surface contour of the handle head and in which the size of the hand loop cannot be adjusted, and namely preferably by the strap of the hand loop being non-positively and not positively fixed, upwardly about the rotational axis into an adjustment position X2, and in this adjustment position X2 the size of the hand loop can be adjusted.

Thus a design which is simple and advantageous, in particular, regarding the assembly, repair and replacement of components, is provided, said design ensuring an excellent fixing of the loop in the resting position and yet permitting a simple longitudinal adjustment of the hand loop in the adjustment position. The loop fastening element can be prefabricated as a module and, together with the hand loop, can be fitted as a whole in a corresponding handle head. Thus the production processes and the storage can also be optimized thereby, since such a unit can be used for different models regarding the further design of the handle. A first preferred embodiment is characterized in that the loop fastening element has a through-opening through which the loop strap of the hand loop is guided out of the pole handle, is guided around the hand of the user, and passes again through the loop fastening element, through the same through-opening with the free end, wherein preferably the free end of the loop strap is guided downwardly to the rear of this through-opening around the loop fastening element around a deflection region, and is then guided out of the handle head below the loop as a free loop end.

Preferably, in the resting position the loop strap is fixed in its position between the loop fastening element and the core of the pole handle by pure clamping, i.e. by a non-positive connection. In particular, in this case holes in the loop strap for a positive fastening are dispensed with, in order to permit as many different positions as possible.

This loop guidance permits at the same time an effective clamping and, on the other hand, also advantages regarding modularity, since the prefabricated unit consisting of the loop fastening element and the hand loop can be assembled in a simple manner, in particular when one end of the loop is fastened to the loop fastening element. In the resting position, the loop strap is preferably fixedly clamped between a lower face of the loop fastening element and an opposing base of the central recess.

Preferably, in this case means are arranged in the clamping region and/or in the deflection region in order to prevent the adjustment of the size of the hand loop.

These means can preferably be configured at least partially in the form of one or more clamping projections or clamping protrusions and/or corresponding recesses, steps or grooves in the mating surface.

Particularly preferably, in this case at least one rib running transversely to the direction of travel is arranged on the lower face of the loop fastening element, and a corresponding step is arranged in the opposing base of the central recess.

A further preferred embodiment is characterized in that the loop fastening element is tiltably fastened to the core of the pole handle by means of a transverse pin arranged along the rotational axis transversely to a direction of travel and transversely to the pole handle longitudinal axis in a through-opening of the core of the pole handle.

The loop fastening element can additionally be fastened by means of a direct or indirect connection to the core of the pole handle, i.e. in particular secured against loss, said connection preferably providing at the same time a guide function for the tilting movement between the resting position X1 and the fixed position X2. In particular, projections are preferably provided therefor on the core and/or on a separate element, said projections engaging at least partially in curved recesses in the lateral surfaces.

Further preferably, latching elements which permit the loop fastening element to be at least partially latched in the resting position X1 and/or in the adjustment position X2 can be provided. Preferably, such a mechanism is provided in both positions.

In this case, the loop fastening element can have at least one first latching channel in at least one lateral surface in which at least one first latching cam engages in the resting state X1, wherein the loop fastening element preferably has two latching channels or latching grooves which are arranged on two lateral walls of the loop fastening element, which are arranged parallel to one another and opposing one another. Preferably, the core has two latching cams which are oriented inwardly into the central recess and which are arranged on two lateral walls of the core, which are arranged substantially parallel to one another and opposing one another, and which engage in the two latching channels.

Alternatively or additionally, it is possible that the loop fastening element has at least one second latching channel in at least one lateral surface in which at least one first latching cam engages in the adjustment position X2, wherein the loop fastening element preferably has two latching channels or latching grooves which are arranged on two lateral walls of the loop fastening element, which are arranged parallel to one another and opposing one another, and wherein preferably the core has two latching cams which are oriented inwardly into the central recess and which are arranged on two lateral walls of the core, which are arranged substantially parallel to one another and opposing one another, and which engage in the two latching channels.

A further preferred embodiment is characterized in that the hand loop has a loop portion circulating around the hand of the user, and a deflection portion which adjoins the loop portion on one side, which is inserted into a slotted through-opening of the loop fastening element, and which is guided downwardly in the central recess around a deflection region of the loop fastening element, and a first free end which protrudes from the central recess and which adjoins the deflection portion, wherein the hand loop additionally has a second end which adjoins the peripheral loop portion and which is fastened to the loop fastening element, preferably on a front wall of the loop fastening element which is arranged in the central recess of the pole handle, in particular preferably by means of a fastening means which preferably is a screw, a rivet, a pin, a hook, an adhesively bonded connection or a combination thereof.

The loop fastening element can preferably have at least one recess which is preferably arranged transversely to the direction of travel.

Furthermore, the loop fastening element can have means which ensure a seal, in particular in the form of a projection and/or a sealing lip, on its front surface in the transition to the top portion (forming the surface of the handle head during use in the resting position X1).

The pole handle can additionally have at least one, preferably clamp-shaped, attachment which is positively and releasably connected to the loop fastening element and/or to the core. For example, in each case there can be two laterally positioned attachments. In the case of a clamp-shaped attachment, this can have two lateral walls which converge in a front wall in the direction of travel and which are connected downwardly by a base in a front region, wherein the lateral walls in each case have a free end which is oriented to the rear counter to the direction of travel and on which in each case a latching pin is arranged, and wherein the latching pins engage in each case in a curved guide channel which is arranged on opposing lateral walls of the loop fastening element, whereby during a tilting movement of the loop fastening element the loop fastening element is guided in the central recess of the pole handle, and wherein the at least one guide channel is preferably configured along the curvature of a top portion of the loop fastening element.

Typically, the attachment is positively and releasably connected to the core (1*a*) of the pole handle, preferably by means of at least one latching connection.

The angle between the resting position X1 and the adjustment position X2 advantageously ranges from 20-90°, preferably ranges from 30-80°, in particular preferably ranges from 45-70°.

The pole handle preferably has a first positive connection between the core and the loop fastening element as well as a second positive connection between the loop fastening element and the attachment and a third positive connection between the core and the attachment.

The loop fastening element can have a curved top portion which in the fixed position is integrated at least partially, or in particular virtually entirely, in an external contour of the head region.

The handle head preferably protrudes in a front region over the handle region. For improved ease of gripping, the handle head has on its front lower face at least one elevation, preferably approximately at half the distance between the front edge of the handle region and the tip of the handle head. Further preferably, the lower face, and optionally at least partially also a region which extends slightly to the rear at the side, is produced from a material which is particularly easy to grip. Typically, the core of the handle head consists of a hard thermoplastic material, such as for example polyamide, polycarbonate, polyethylene, polypropylene or mixtures thereof, respectively glass fiber-reinforced. In the lower region of the handle head a more flexible elastomer material can be provided as a material which is easy to grip and which preferably also provides the above-mentioned elevation. The entire core of the handle, or at least the upper region with the handle head, can accordingly be manufactured from a single material or in a two-component method with an elastomer insert, in particular on the lower face of the handle head.

The upper face, respectively the top surface, and a top portion of the loop fastening element can also be configured from an elastomer material which is easy to grip or at least with a coating consisting of an elastomer material which is easy to grip.

The present invention further relates to a method for the assembly of a pole handle, as set forth above, which is characterized in that the hand loop is fastened with a free end to the loop fastening element and is then inserted as a module into the central recess and is tiltably fastened via a transverse pin in the handle head. Preferably, before the loop fastening element is inserted or subsequently thereto, an attachment is preferably pushed on from the side or from the front and fastened to the handle head, preferably in a self-latching manner. As a result, the attachment is secured via the loop fastening element, respectively the loop fastening element is secured via this attachment, respectively regions thereof, to the handle head. Preferably, the loop fastening element is additionally guided for the tilting movement by an engagement of the attachment.

Finally, the present invention relates to a pole, in particular ski pole, cross-country ski pole or Nordic walking pole, having a pole handle as set forth above, respectively assembled as set forth above.

Alternatively or additionally, in the present case the invention relates to a pole handle having the following properties:

A pole handle, in particular for a ski pole, cross-country ski pole, trekking pole or Nordic walking pole, having a head region and a handle region and an axial recess which is open at the bottom on one side for receiving a pole tube.

In this case, such a pole handle is characterized, in particular, in that the pole handle has a core made of the actual structure-forming material (for example and preferably from a thermoplastic material such as in particular polyamide, polycarbonate, polypropylene, polyethylene or mixtures thereof, optionally (glass) fiber-reinforced), wherein the core has at least in some regions a first left-hand lateral wall and a second right-hand lateral wall in the interior of the handle.

In this case, the two lateral walls are connected on the upper face by a top surface, wherein the lateral walls and top surface enclose a hollow space and the first left-hand lateral wall and the second right-hand lateral wall in the head region define the hollow space to the side. In this case, both lateral walls respectively have at least one, or preferably two, through-holes in a direction transversely to the pole handle longitudinal axis and transversely to the direction of travel, when used as intended.

The individual through-hole surface of at least one of the through-holes, preferably the majority or all of the through-holes, in this case is more than 10 $mm^2$, in particular more than 15 $mm^2$, in particular ranging from 10-50 $mm^2$. Alternatively or additionally, the total surface area of the through-holes on at least one or both sides, i.e. in a lateral wall of the handle, is more than 10 $mm^2$, preferably more than 15 $mm^2$, or more than 20 $mm^2$, in particular ranging from 10-50 $mm^2$.

Due to the design with the lateral walls and the through-holes in these lateral walls, an elongated hollow space can be produced in a structurally stable manner in the interior of the handle head, without having to take into account losses in stability in the case of high loads. A high degree of stability can be ensured by the webs of this, for example, organic structure, and the proposed design can also be produced in a simple manner in the conventional method (injection-molding method) for the core of the pole handle.

A first preferred embodiment is characterized in that webs are configured between the through-holes or the through-holes are formed by a lattice structure with through-holes.

At least one or more of the through-holes can be configured in the form of polygons, optionally with rounded corners, for example in the form of triangles, quadrilaterals (kite, rhombus, square, rectangle, trapezoidal shape, for example parallelogram, trapezium). Typically the top surface is configured to be closed or lattice-shaped. If the top surface is configured to be lattice-shaped with complete through-holes, preferably the attachment which is described in more detail below, or a separate attachment or a coating, also covers the surface of the top surface in order to prevent the penetration of dirt or the like.

The pole handle preferably has at least one attachment which is preferably releasably fastened to the core and which in some regions encloses the core in the head region, preferably in the peripheral direction, and which at least partially, preferably entirely, covers the through-holes and/or recesses in the top surface entirely on the outer face, wherein the attachment is preferably fastened non-positively and/or positively to the core and/or positively fastened to a loop fastening element which is also incorporated in the handle head. There can be, for example, two attachments in each case positioned at the side.

The attachment is typically and preferably produced from a transparent or translucent thermoplastic material, for example polyamide, polycarbonate, polyacrylate (e.g. PMMA), POM or a mixture of such materials, so that the view of the internal structure is revealed.

The pole handle with the head region and the handle region preferably has a hard core made of a thermoplastic material and a flexible material arranged thereon, for example made of a foam or cork in the handle region. In this case, the hard core made of a thermoplastic material can have a peripheral recess in the handle region in which a corresponding casing made of foam or cork is arranged. Thus not only is a further reduction in weight achieved but the pole handle is easier to grip.

The casing can consist of foam (for example EVA) cork or even from a composite material consisting of wood, bast, textile, non-woven fabric, metal ora combination of such materials.

So that such structures can also be assembled, the hard core can be detached, i.e. have a peripheral slot, in the lower handle region, i.e. in that region in which the axial recess is provided for a pole tube. Thus the two-part hard core of the handle can be assembled with the casing, by the upper region or the lower region of the hard core being prepositioned, the peripheral casing being pushed on, and the other region of the hard core being pushed into the other free opening of the casing and the parts connected together, for example adhesively bonded.

This proposed design can also be used to provide pole handles of different sizes and different shapes in a semi-modular manner. Thus it is possible, for example, to configure the length of the handle region differently, by providing in each case the same head region and upper hard core, and lower hard core regions of different length, and then combining a casing of the desired length with a lower hard core region of the desired length always with the same upper hard core.

Furthermore, it is possible additionally, or independently therefrom, to design the casing with a different shape, with the hard core remaining the same. Thus when the hard core remains the same, a whole series of different handles can be provided, simply by different casings being used, wherein the different casings can vary regarding the material and/or shaping.

In particular preferably, all possibilities for variants can be utilized within the context of a handle series, for example by providing a single hard core upper part with a handle head which is always the same, and lower hard cores of variable length depending on the desired length of the handle region, and casings of variable length made of different material and having a different shaping. Alternatively, the upper parts with the handle head and hard core region can also have different lengths and can be combined with the lower hard core regions, either having the same length and shaping or even having a different length and shaping. Thus ultimately even user-specific, individualized combinations can be provided with relatively low effort during production, which opens up interesting possibilities, in particular with the current options of Internet shipping directly from the production site to the customer.

The pole handle having a pole longitudinal axis and a front pole handle region facing in a direction of travel and a rear pole handle region oriented opposite the direction of travel, and a gripping region and a bulged head region adjoining the gripping region, wherein the gripping region has an upper gripping region adjacent to the head region and a lower gripping region facing away from the head region, typically has in the head region a handle nose which in the front pole handle region substantially transitions into the upper gripping region without a protrusion, wherein the handle nose in the front pole handle region in the direction of travel is configured to protrude over the gripping region in an overhang.

The overhang in this case is typically more than ca. 50% of a central extension of the gripping region in the direction of travel. Typically, in this case a cutting plane of the head region which is spanned by a transverse axis of the head region, said transverse axis being arranged transversely to the pole longitudinal axis and transversely to the direction of travel and being arranged where the head region is at its widest, measured transversely to the direction of travel and transversely to the pole longitudinal axis, and a foremost tip of the handle nose, is angled back at an obtuse angle from the pole longitudinal axis, in the region of 90-135 degrees.

The attachment in this case can be configured as a clamp with two lateral arms, wherein the arms of this clamp grip the handle head approximately from the front, and wherein the arms extend rearwardly from a front wall of the attachment to the rear region of the head region of the pole handle and at the same time partially cover the lateral walls, and preferably entirely cover the through-holes arranged therein, on the outer face.

In this case, preferably each of the lateral arms has at least one first means for the non-positive and/or positive connection to the core, and preferably additionally at least one second means for the non-positive and/or positive connection to a coupling element, wherein preferably at least the second means is a latching means which latches in a latching recess or on a latching projection of a latching structure in the core.

Both the first, left-hand lateral wall and also the second, right-hand lateral wall can have in each case at least three through-holes in the head region, in a direction transversely to the pole handle longitudinal axis and transversely to the direction of travel.

The first lateral wall and the second lateral wall preferably have in each case at least two or three through-holes separated from one another by a web, wherein the webs extend from the top surface of the pole handle downwardly in the direction of the handle region, and are preferably arranged substantially parallel to the pole handle longitudinal axis or inclined at an angle to the pole handle longitudinal axis.

The webs are preferably oriented in an inclined manner relative to the pole handle longitudinal axis, wherein preferably webs arranged further to the front in the direction of travel are inclined from bottom to top toward the front, in particular preferably at an angle relative to the pole handle longitudinal axis of 20-80°, or ranging from 30-60°, and webs arranged further to the rear in the direction of travel are inclined from bottom to top toward the rear, in particular preferably at an angle relative to the pole handle longitudinal axis of 10-70°, or ranging from 20-60°.

The through-holes in the two lateral walls are preferably configured to be mirror-symmetrical relative to a plane spanned by the pole handle longitudinal axis and the direction of travel.

The lateral walls are also preferably offset in an upper region of the head region relative to a lower region of the head region inwardly toward the hollow space, whereby a shoulder which partially circulates around the head region in the peripheral direction is formed between the upper region of the head region and the lower region of the head region, the attachment being at least partially positioned on said shoulder, wherein preferably a substantially continuous surface of the handle region, which is closed apart from gaps between components, is configured by the shaping of the attachment and the position thereof in this offset region.

The webs typically extend from the top surface of the pole handle downwardly in the direction of the handle region as far as the partially peripheral shoulder.

A further preferred embodiment is characterized in that the attachment is configured to be at least partially, preferably entirely, transparent or see-through (translucent), so that the through-holes of the core are visible from the outside. In the head region which is defined upwardly by a top surface on the rear face, the pole handle can have a central recess in which a loop fastening element with a hand loop fastened to the loop fastening element is received in a rear region of the head region, wherein the loop fastening element preferably has a through-hole which is aligned with a through-hole of the lateral walls, so that in a resting position, when viewed through the through-hole of the lateral walls, the loop fastening element is substantially not visible from the outside.

The pole handle according to the invention further preferably has two laterally curved or angled-back webs between the top surface and a lower region of the handle head on the rear face of the handle head, preferably a loop fastening element as described above being arranged between said webs.

Moreover, the pole handle can have an attachment which is releasably fastened to the core and which in some regions encloses the core in the head region in the peripheral direction, and which at least partially, preferably entirely, covers the through-holes and/or recesses in the top surface including the through-hole formed by the webs, on the outer face, wherein the attachment is preferably fastened non-positively and/or positively to the core and/or is positively fastened to a loop fastening element which is also incorporated in the handle head, by regions of the attachment engaging behind the webs on the inner face, and optionally engaging so as to be guided in curved recesses of a loop fastening element. As a result, the use of additional fastening elements can be dispensed with.

Further embodiments of the invention are laid down in the dependent claims.

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same. In the drawings.

DESCRIPTION OF PREFERRED EMBODIMENTS

A first preferred exemplary embodiment of the pole handle 1 according to the invention is shown in FIGS. 1-14. In this case, the same reference signs denote the same elements according to the list of reference signs.

Figures 1A, 1B:
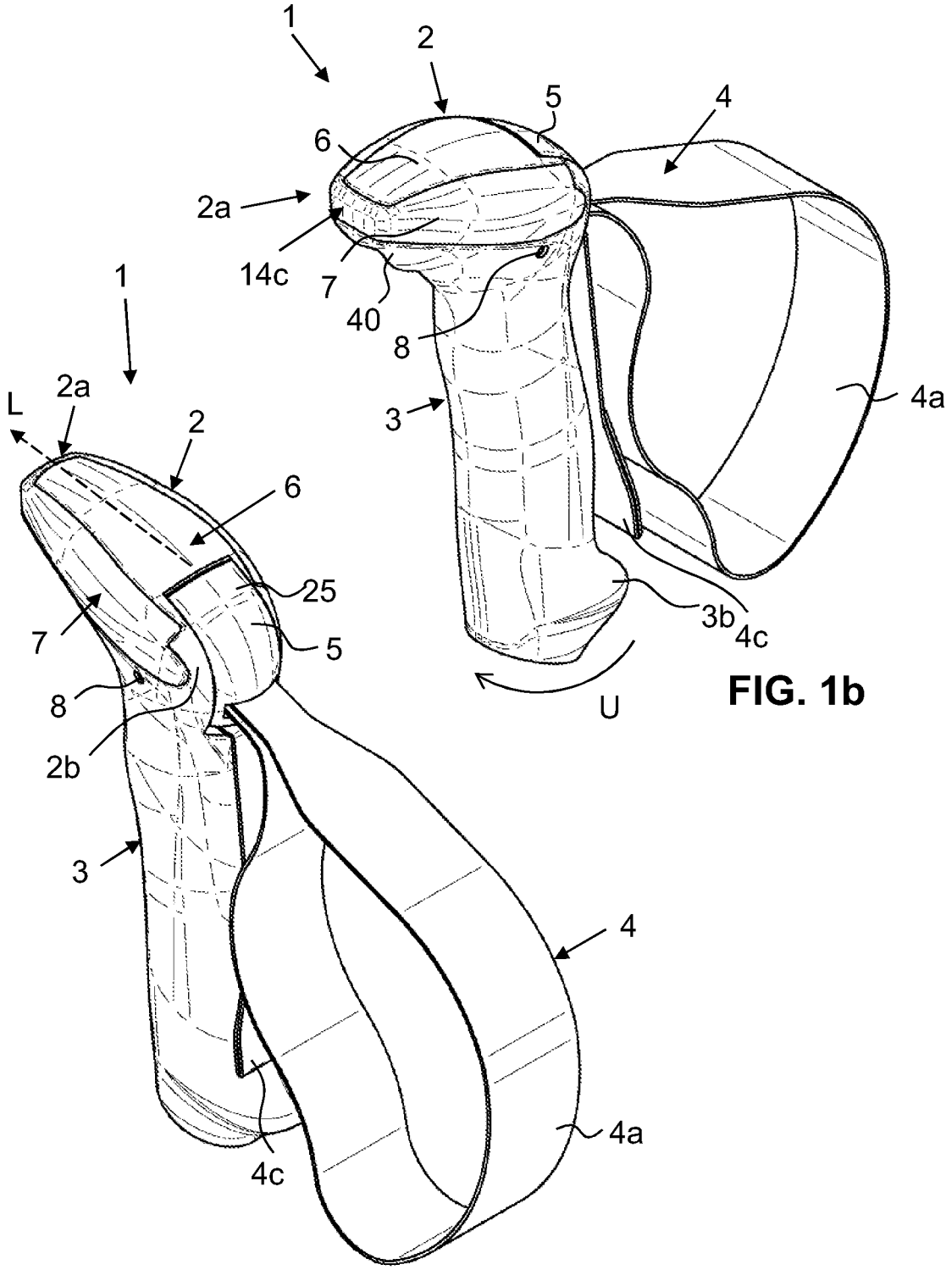
FIG. 1*a* and FIG. 1*b* show perspective views of the pole handle according to a first exemplary embodiment in a) from top left to the rear and in b) from top left to the front.
Figure 2:
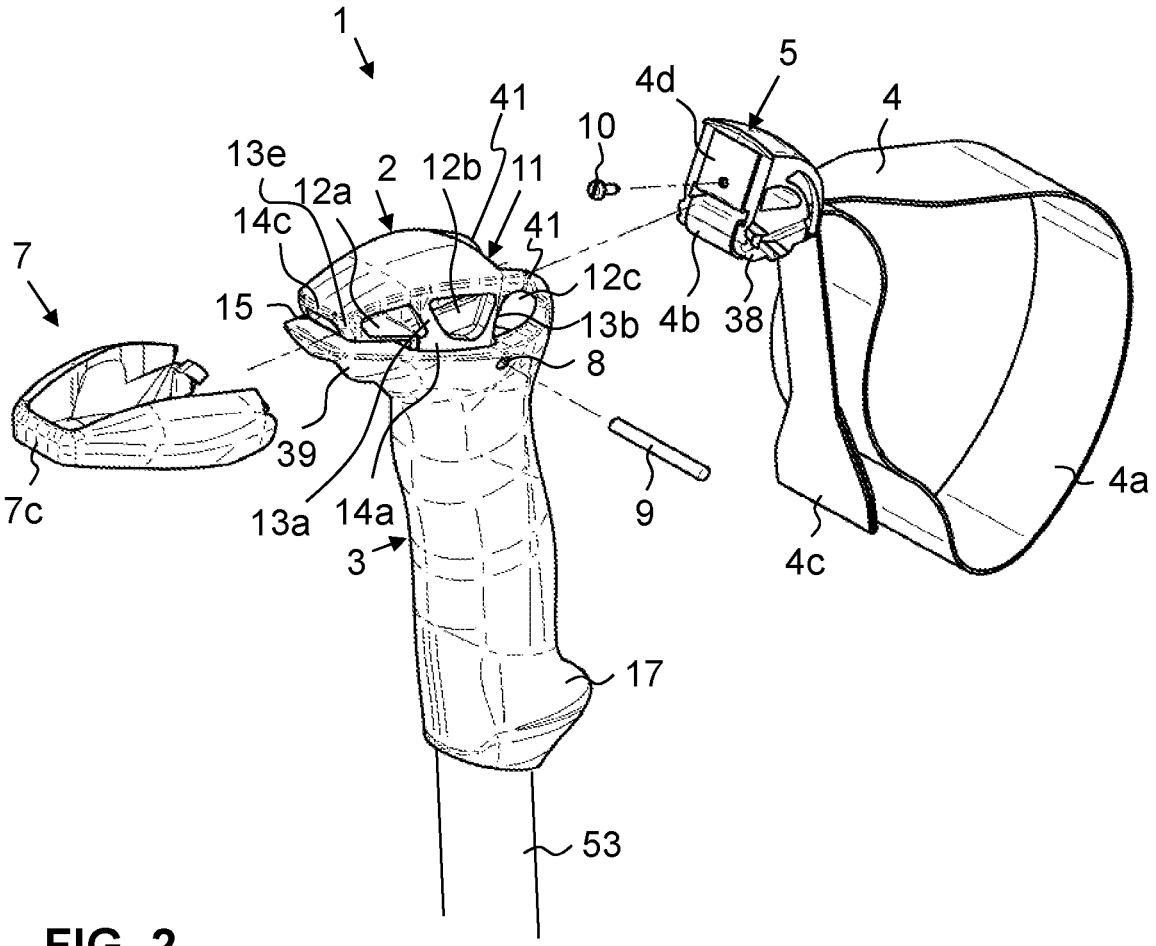
FIG. 2 shows a perspective exploded view of the pole handle according to a first exemplary embodiment from top left to the front.
Figure 3:
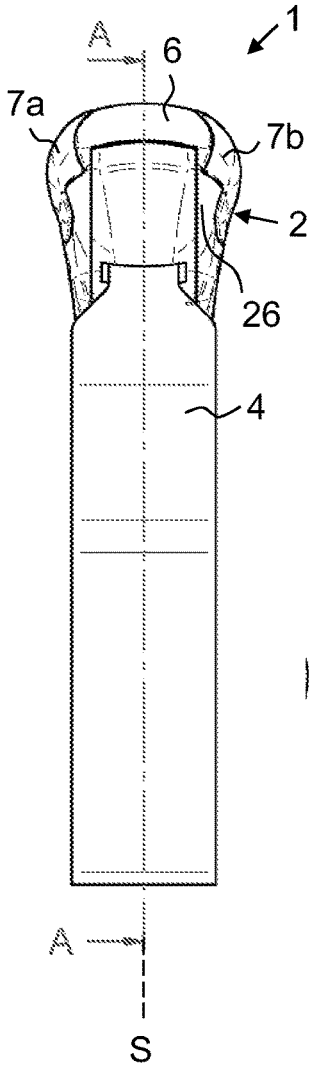
FIG. 3 shows a view of the pole handle according to the first exemplary embodiment from the rear along the direction of travel.

The pole handle 1 (see FIG. 1) has a head region 2 or a handle head and a handle region 3. The pole handle 1 is constructed substantially from the following basic elements, namely a pole handle core 1*a* (typically manufactured from a plastics material in a single-component or multi-component injection-molding method), an attachment element 7 which is pushed or positioned from the front onto the core 1*a* in the head region 2, respectively the handle nose 2*a*, and partially clamps around the front upper handle region of the head region 2, and a coupling module made of a loop fastening element 5 with a hand loop 4 which is fastened thereto and which can be adjusted in terms of size in the present exemplary embodiment. The core 1*a* of the pole handle, as can be identified in FIG. 2 and FIG. 12, is a one-part or multi-part component which is configured in multiple components and which typically has in the handle region 3 a surface coating made of material which is easy to grip, or a corresponding casing typically made of a grip foam or natural material, for example cork. The core 1*a* of the pole handle can also be divided transversely to the pole axis in order to assemble, for example, alternative handle materials in the form of sleeves, which can make up a partial region of the gripping surface. At the lower end of the handle region 3 the pole handle 1 or the core 1*a* of the pole handle 1 has a shoulder 17, oriented to the rear counter to the direction of travel L or oriented toward the pole handle user during use, on which the user can rest the palm of the hand when gripping the pole handle 1 in the lower handle region in the peripheral direction U.

The core 1*a* of the pole handle 1 has a central axial pole handle recess 16 from the bottom, typically defined upwardly toward the handle head, in the form of a blind hole which is arranged substantially along the pole handle longitudinal axis S. The axial recess 16 serves for receiving and fastening a pole tube or pole 53 (not shown in FIG. 1 but shown in FIG. 2) or a tube portion of a pole, in particular of a ski pole, cross-country pole, trekking pole or a Nordic walking pole.

The head region 2 of the pole handle 1 has a front region 2*a* or a handle nose facing in the direction of travel L, wherein the direction of travel L is arranged substantially perpendicular to the pole handle longitudinal axis L and faces away from the user of the pole handle 1. The head region 2 of the pole handle 1 is covered by the user with the inner surface of the hand when the user rests on the pole handle from the top. In the front region 2*a* of the head region 2, the pole handle 1 has an elevation 40 below the handle head 2 in the transition region to the handle region 3. This elevation serves for ease of gripping, in particular when the handle head is gripped from the rear at the top and the fingers enclose this lower front region. Thus, for example, it is possible to place the index finger into the recess in front of this elevation 40 and the middle finger into the recess behind this elevation 40, or shifted by one finger position further, the middle finger in the recess in front of the elevation 40 and the ring finger in the recess behind the elevation 40.

Figure 7A:
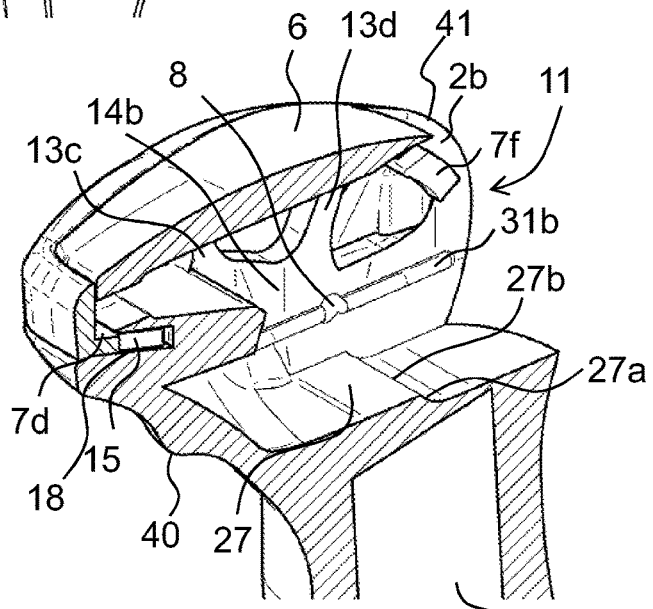
FIG. 7*a* and FIG. 7*b* show sections of the pole handle along the cutting plane A-A of FIG. 3 according to the first exemplary embodiment in a perspective view without the loop fastening element, loop and pin, in a) from top left to the front and in b) from top left to the rear.
Figure 7B:
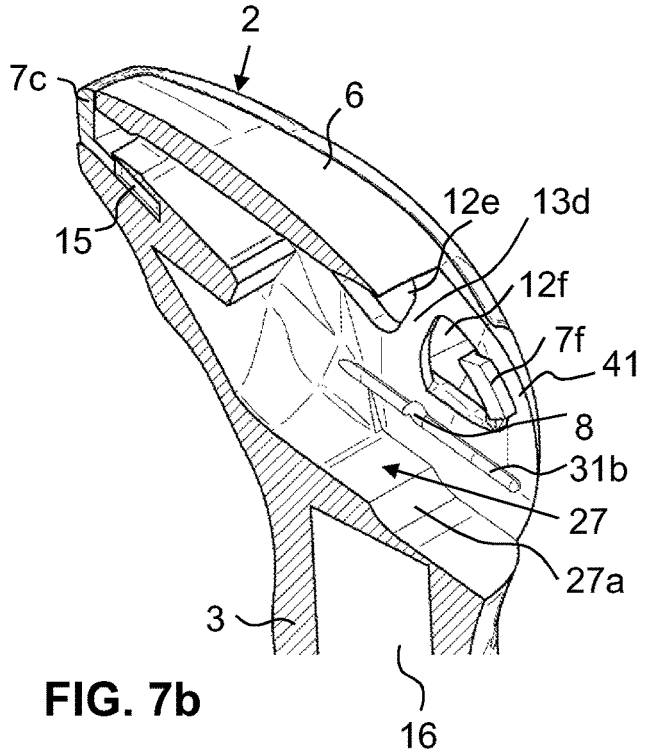
Figure 8:
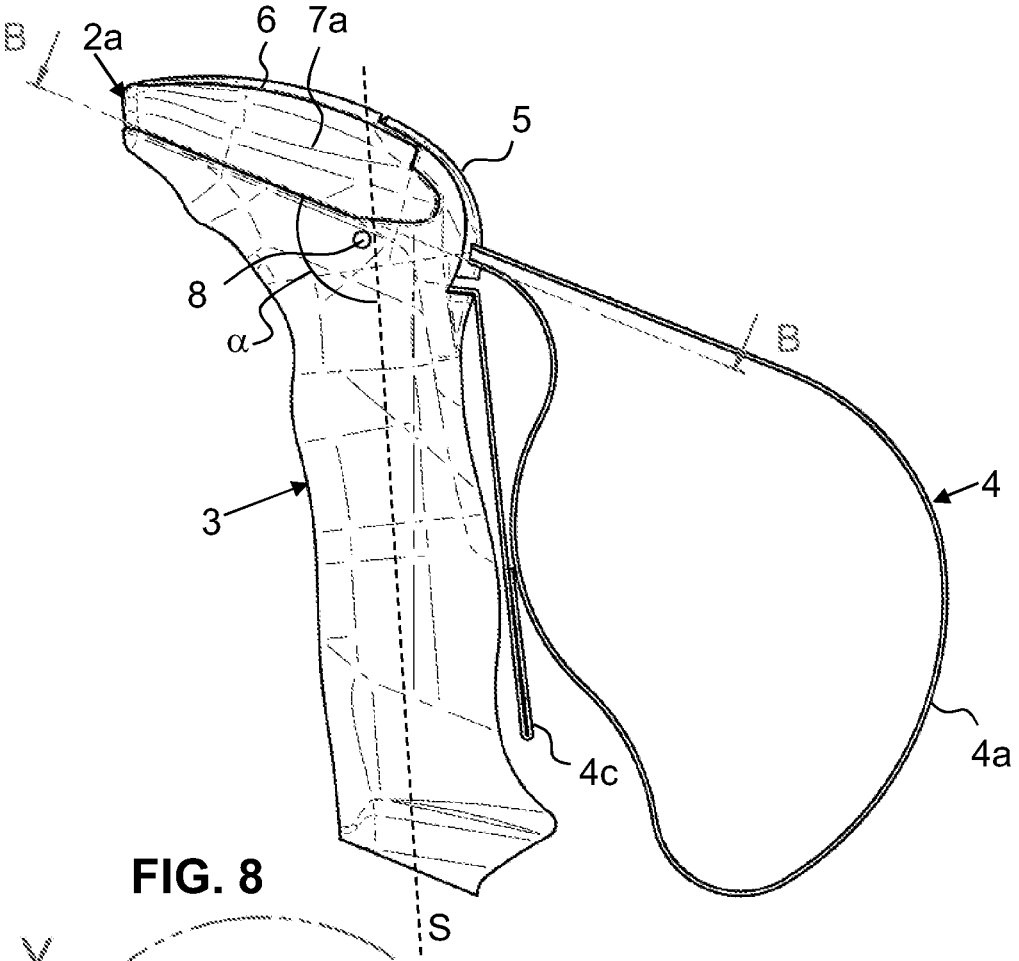
FIG. 8 shows a lateral schematic view of the pole handle according to the first exemplary embodiment from the left transversely to the direction of travel.

The head region 2 of the pole handle 1 has, from the rear on the upper face, a central recess 11 for receiving a loop fastening element 5 for a hand loop 4 (see for example FIG. 2 or FIG. 7). This central recess 11 extends from the rear region 2*b* of the head region 2 as far as the front region 2*a*. The core 1*a* is thus configured to be partially hollow in the head region 2.

The core 1*a* has, when viewed in the direction of travel L, a first left-hand lateral wall 14*a* and a second right-hand lateral wall 14*b*. These lateral walls are open toward the rear face and converge in the front region 2*a* of the pole handle 1 in a front wall 14*c*. In the upper and front handle region 2*a*, the lateral walls 14*a*, 14*b* are offset inwardly in some regions, whereby a shoulder 21 partially circulating in the peripheral direction U is formed. The core 1 a has a plurality of through-holes 12*a*-12*f*, 15 in the aforementioned lateral walls 14 in the head region 2. In the exemplary embodiment shown, these through-holes are implemented by a first through-hole 12*a*, a second through-hole 12*b* and a third through-hole 12*c* in the first left-hand lateral wall 14*a* and by a fourth through-hole 12*d*, a fifth through-hole 12*e* and a sixth through-hole 12*f* in the second right-hand lateral wall 14*b* of the core 1*a*. In this case, two through-holes 12*a*, 12*d* (front), respectively 12*b*, 12*e* (in the middle), respectively 12*c*, 12*f* (rear) oppose one another in the head region 2 of the core 1 a. The through-holes form in each case a through-hole surface 12, i.e. a cross-sectional surface of the respective through-opening.

In the exemplary embodiment shown of FIG. 2, the front wall 14*c* has a seventh through-hole 15.

The through-holes 12*a*-12*f* in the lateral walls 14*a*, 14*b* are separated from one another in each case by webs 13*a*-13*d* and the foremost webs 13*e* and 13*f* in the respective lateral walls 14*a*, 14*b*. The webs 13*a*-13*f* run substantially from the upper face or the top surface 6 of the core 1*a* downwardly in the direction of the handle region 3 as far as the partially peripheral shoulder 21. The top surface 6, which is closed in this exemplary embodiment, is correspondingly supported by a plurality of webs 13, and the lateral walls and the top surface enclose a hollow space 42 which runs in the direction of travel, which transitions at the rear into the recess 11 and which is closed at the front by the front wall 14*c*.

These webs can be oriented substantially parallel to the pole longitudinal axis but, as shown in this exemplary embodiment, can preferably be oriented so as to be adapted as bionic structures to the typical loading directions. Thus here the respective rear webs 13*b*, 13*d* are inclined from bottom to top toward the rear and the front webs 13*a*, 13*c* are inclined from bottom to top toward the front, in each case typically toward the rear at an angle of 30-60°, relative to the pole longitudinal axis, and toward the front at an angle of 20-45° relative to the pole longitudinal axis. This results, to a certain extent, in a lattice structure or network structure of the core 1*a* in the upper head region 2 for supporting the top surface 6.

Furthermore, in each case the top surface 6 is borne toward the rear on either side by an arcuate web 41 which connects the top surface 6 to the lower part of the core and encloses and guides the loop fastening element 5 at the side.

The surface of the head region 2 of the pole handle 1 and thus the gripping surface from above (see FIG. 11) is partially formed by the upper face, respectively the top surface 6, of the core 1*a*, partially by the attachment element 7 and partially by the loop fastening element 5. In this case, the curved upper face or the top portion 25 of the loop fastening element 5 in the resting position or the untilted fixed position is approximately fully integrated in the external contour of the head region 2. In this case, when the loop fastening element is removed, in a side view (see FIG. 14) the surface of the head region has a first protrusion 19 in the transition of the upper face to the loop fastening element, and a second protrusion 20 in the transition to the lower handle region, so that here the loop fastening element is embedded in the surface of the handle head flush with the contours.

Figure 9:
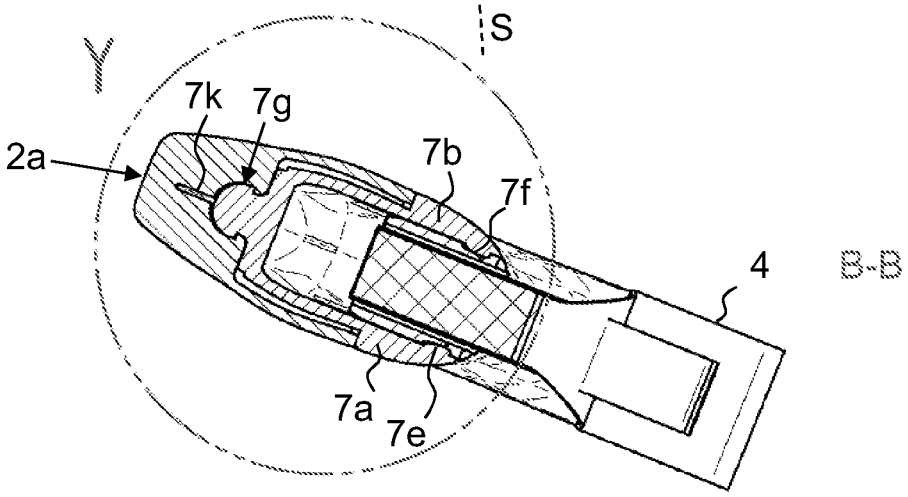
FIG. 9 shows a section Y along the cutting plane B-B of FIG. 8 with the hand loop.
Figure 10:
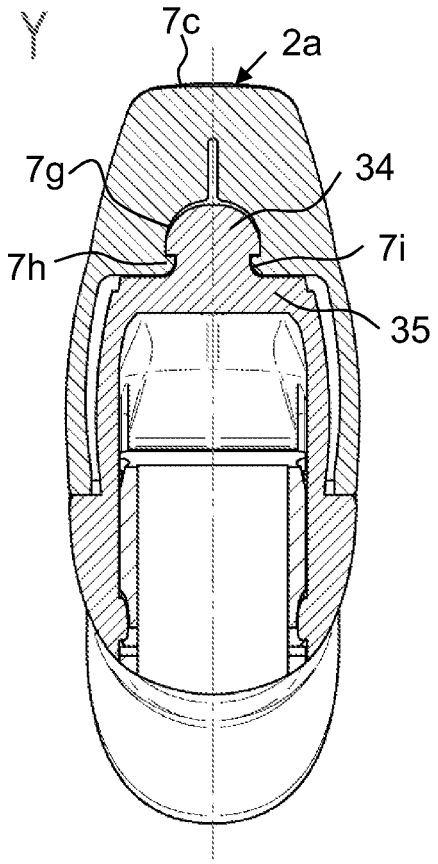
FIG. 10 shows an enlarged view of the section Y of FIG. 9 without the hand loop.
Figure 11:
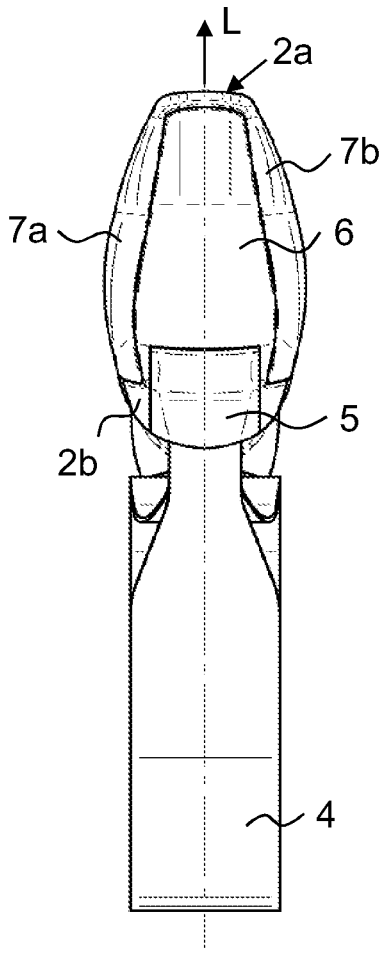
FIG. 11 shows a schematic view of the pole handle according to the first exemplary embodiment from above along the pole handle longitudinal axis with the hand loop.
Figure 12A:
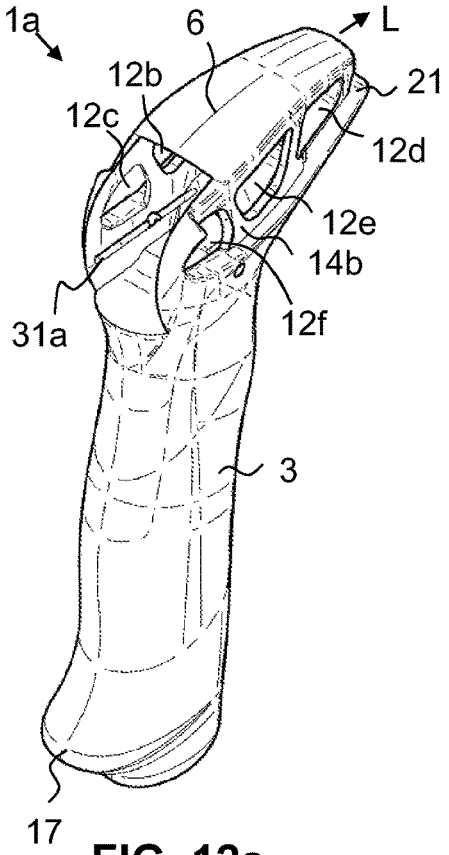
FIG. 12*a* to FIG. 12*d* show views of the pole handle according to the first exemplary embodiment, wherein only the core of the pole handle is shown, i.e. without the attachment element, without the pin, without the loop fastening element and without the hand loops, in a) perspectively from top right to the rear, in b) perspectively from top left to the front, in c) a view from the front counter to the direction of travel, in d) a lateral view from the left transversely to the direction of travel.
Figure 12B:
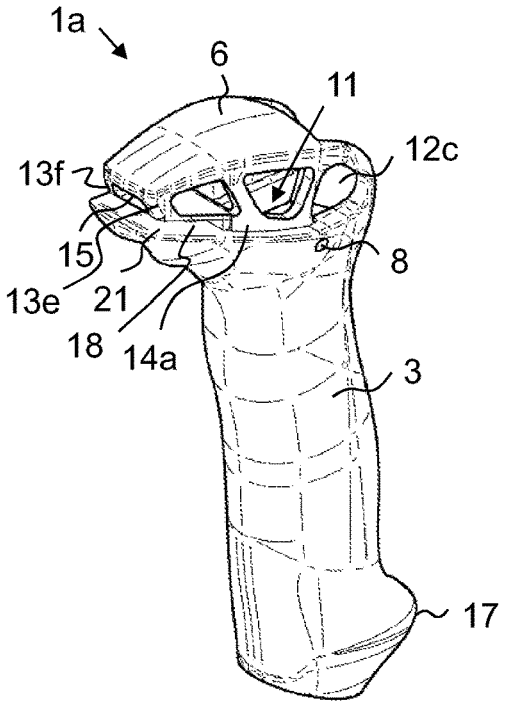
Figure 12C:
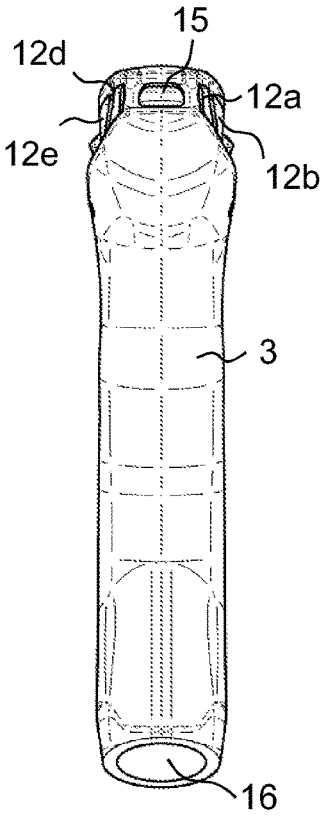
Figure 12D:
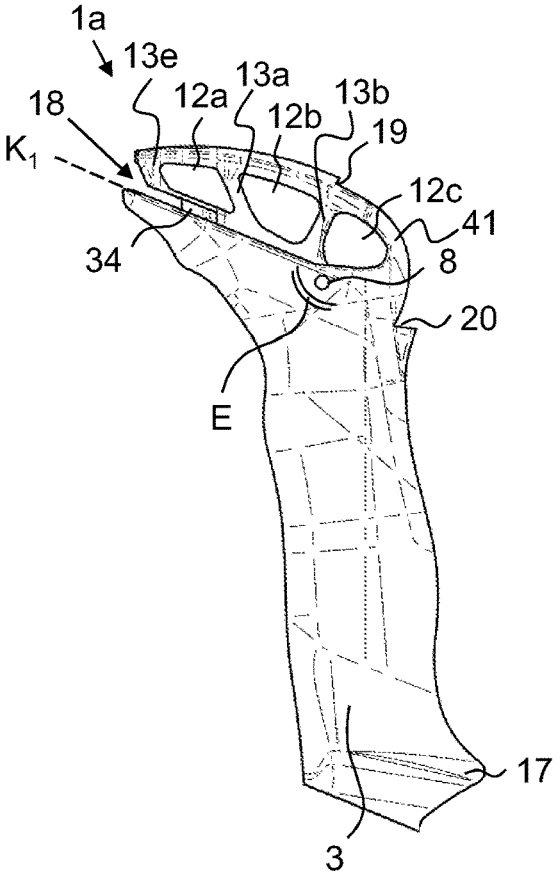
Figure 13A:
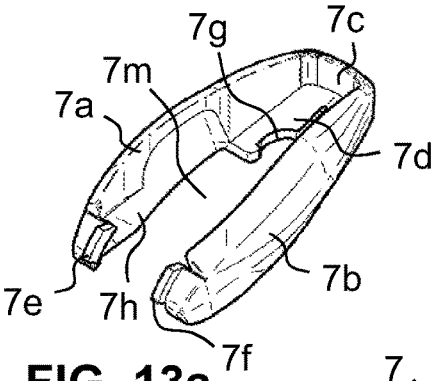
FIG. 13*a* to FIG. 13*g* show views of the attachment of the pole handle according to the first exemplary embodiment in a) perspectively from top right to the rear, in b) perspectively from top left to the front, in c) from above, in d) a sectional view along the cutting plane D-D in c), in e) a sectional view along the cutting plane E-E in c) viewed in the direction of travel, in f) a sectional view along the cutting plane F-F in d), in g) a view from below.
Figure 13B:
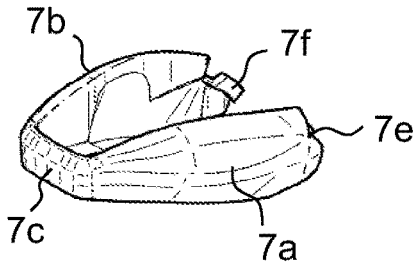
Figure 13C:
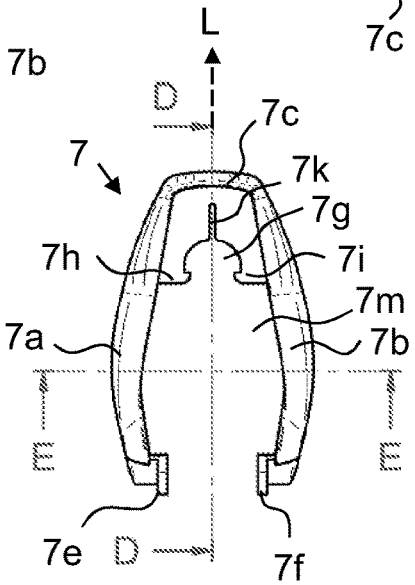
Figure 13D:
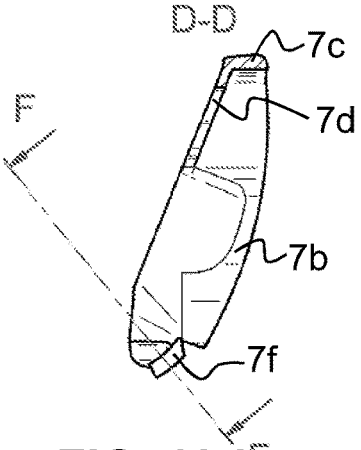
Figure 13E:
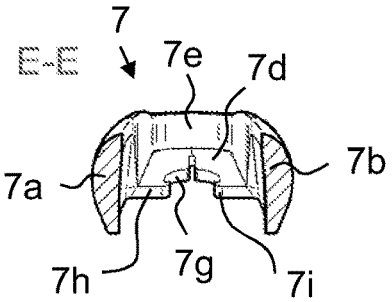
Figure 13F:
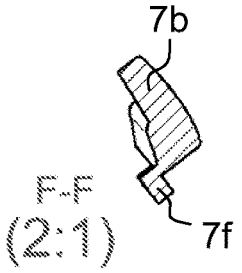
Figure 13G:
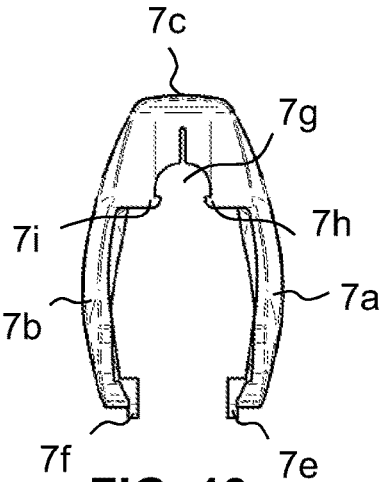
Figure 14A:
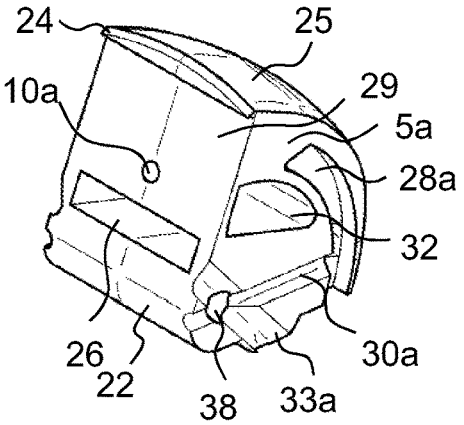
FIG. 14*a* to FIG. 14*h* show views of the loop fastening element of the pole handle according to the first exemplary embodiment, in a) perspectively from top left to the front, in b) perspectively from top right to the rear, in c) from below, and in d) from the right, when viewed transversely to the direction of travel, in e) from the rear, in f) from the left, in g) from the front, when viewed counter to the direction of travel, and in h) from above.
Figure 14B:
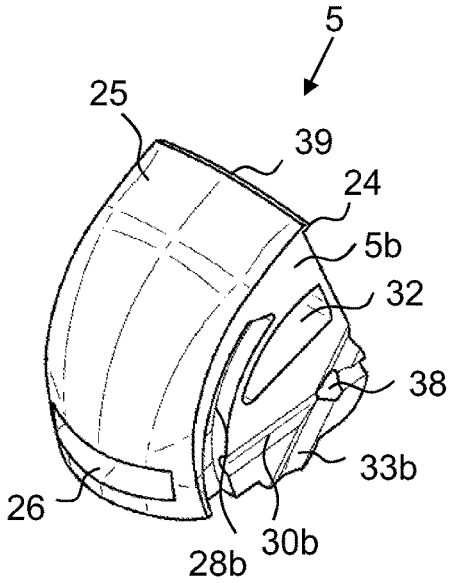
Figure 14C:
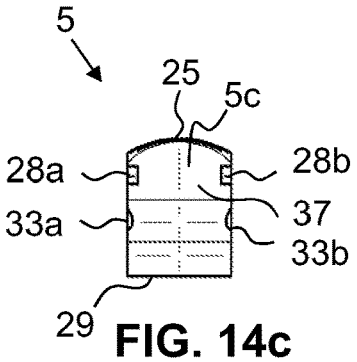
Figure 14D:
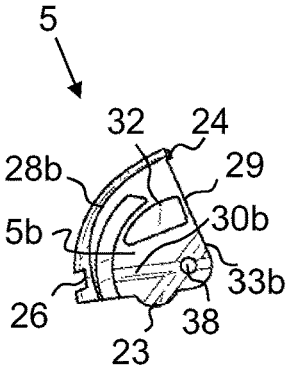
Figure 14E:
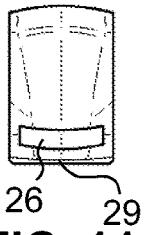
Figure 14F:
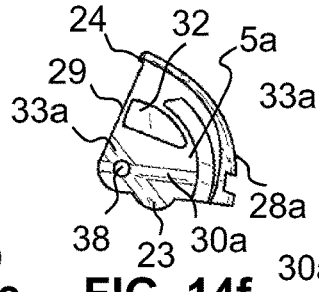
Figure 14G:
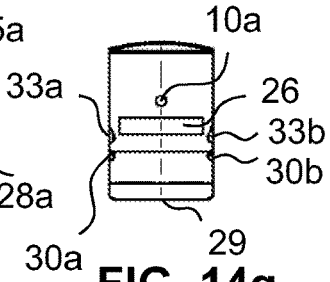
Figure 14H:
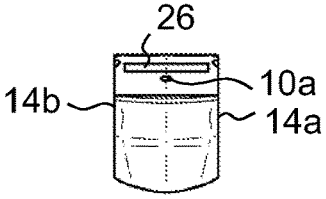

The attachment element 7 grips or covers the front region or the front wall 7*c* of the core 1*a* in the head region 2 of the pole handle 1 with the front wall 7*c* of the attachment element 7, which is configured to a certain extent as a clamp, and with its two arms 7*a*, 7*b* extending laterally in each case from the front wall 7*c* covers the flanks or lateral walls 14*a*, 14*b* of the core 1*a*, as can be identified in the exploded view of FIG. 2. The attachment 7 thus encloses with its two lateral walls 7*a*, 7*b* and its front wall 7*c* on three sides the front region of the handle head and the two lateral regions of the lateral walls 14. Furthermore, the attachment encloses a region which serves for receiving a latching structure 35 in the interior of the head region 2 of the core 1*a*, as shown in FIG. 9 and FIG. 10.

In the front region of the attachment 7, this attachment has a base 7*d* which connects together the two lateral walls 7*a*, 7*b*, (see FIG. 13) and which has a recess 7*g* and defines the interior in the front region toward the bottom. The base 7*d* extends substantially parallel to the cutting plane B-B, illustrated in FIG. 8, which extends parallel to a longitudinal axis of the head region K1. When the attachment 7 is pushed from the front onto the core 1*a* in the head region 2 of the pole handle 1, the base 7*d* slides at least partially from the front into a slot 18 in the latching structure 35 and the attachment 7 is latched on the core 1*a* of the pole handle 1. This is permitted by a positive connection between a latching tongue 34, which is configured to be substantially semi-circular with an undercut on the latching structure 35 in the interior of the head region 2, and the corresponding recess 7*g* in the base 7*d* of the attachment (see FIG. 10). The recess 7*g* has a slot-like extension 7*k* oriented in the direction of travel L in order to permit the widening of the attachment 7 for the latching process. The recess 7*g* is defined toward the interior 7*m* and to the rear by two lugs 7*h*, 7*i* oriented inwardly, substantially transversely to the longitudinal axis of the lateral arms 7*a*, 7*b* of the attachment. When positioning the clamp-shaped attachment, the two lugs 7*h*, 7*i* engage below the two opposing foremost through-holes 12*a*, 12*d* into the slot 18 in the head region 2 of the core 1*a* and are latched in the undercut behind the latching tongue 34 of the core 1*a*, to a certain extent in each case in a latching recess or in the respective undercut.

The through-holes are all overlapped or covered in each case by one lateral arm 7*a*, 7*b* of the attachment. The front wall 7*c* and the lateral walls 7*a*, 7*b* of the attachment are located in the positioned state on the shoulder 21 of the core 1*a* which circulates around the head region 2 in the front region 2*a* and on the two sides, and seamlessly transitions with the curvature of the head region 2 into the rear region 2*b*. The arms 7*a*, 7*b* have a concave curvature oriented toward the interior 7*m* of the attachment 7. The cover element 7 thus serves, amongst other things, to a certain extent for sealing the open lightweight design with the webs and thus for preventing dirt or the like from being able to penetrate into the handle head, and on the other hand for providing a surface for the handle which as far as possible is smooth and free of transitions. The cover element is typically and preferably produced from a transparent or translucent thermoplastic material, for example polyamide, polycarbonate, polyacrylate (e.g. PMMA), POM or a mixture of such materials, so that the view of the internal structure is revealed.

At the free end of the respective first left-hand arm 7*a* or of the second right-hand arm 7*b* of the attachment, each arm 7*a*, 7*b* respectively has a latching hook, latching projection or latching pin 7*e*, 7*f*. This latching pin 7*e*, 7*f* extends initially inwardly from the respective arm 7*a*, 7*b*, i.e. toward the interior 7*m* of the attachment 7, and then toward the upper rear face. These latching pins 7*e*, 7*f* serve for fastening the attachment 7 to the loop fastening element and thus indirectly for fastening the attachment to the core 1*a*, and the latching pins also have a guiding function for the loop fastening element 5 as described further below. The latching pins 7*e*, 7*f* in this case engage from outside through the through-holes 12*c*, respectively 12*f*, and then engage in each case behind the arcuate web 41. In other words, the attachment 7 is pushed on so as to grip from the front, then grips with the latching pins around the webs 41 on the inner face and is latched to the recess 7*g* on the latching tongue 34 further toward the front.

The head region 2 of the pole handle 1 also has a rear region 2*b* which faces the pole handle user and in which a hand loop 4 is fastened. In the first exemplary embodiment shown, the hand loop 4 is connected to the pole handle 1, or coupled thereto, via the loop fastening element 5 which is arranged in the central recess 11 in the head region 2*a* of the pole handle 1 and in the embodiment shown is tiltable by a movement indicated in FIG. 5*a*. In the exemplary embodiment shown, the loop fastening element 5 is to a certain extent of block-shaped configuration. The central recess 11 of the pole handle 1 is defined downwardly in the core 1*a* by a base 27 and is separated from the upper end of the pole handle recess 16. The hand loop 4 has a loop portion 4*a* which is configured to enclose at least partially a hand or a wrist of the pole handle user. The loop portion 4*a* is arranged between a first free loop end 4*c*, which emerges from the pole handle interior and which can be pulled by hand for the purposes of reducing the loop width, and a second loop end 4*d* which is fastened in or on the loop fastening element 5.

Figure 6:
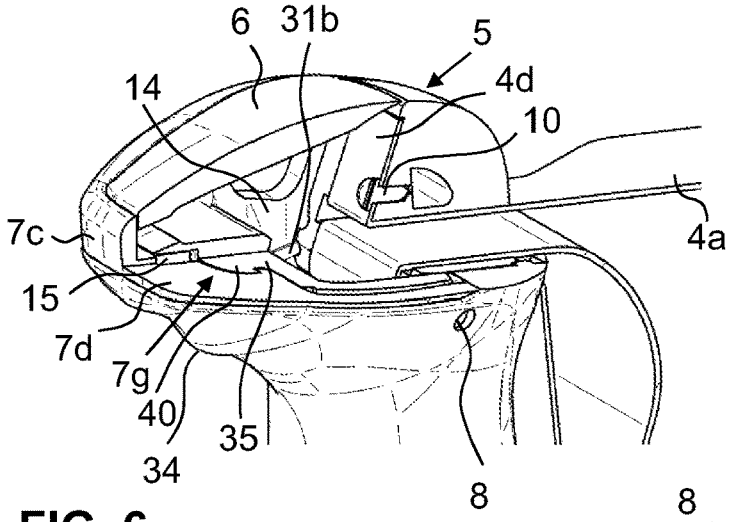
FIG. 6 shows a section of the pole handle according to the first exemplary embodiment in a perspective view from top left to the front, with the inserted loop fastening element, wherein the head region of the pole handle along the cutting plane A-A of FIG. 3 to the cutting plane B-B of FIG. 8 is cut out in a quadrant.

In the first exemplary embodiment shown, a deflection portion 4*b* is arranged between the loop portion 4*a* and the first free loop end 4*c*, said deflection portion being guided around a deflection region 22 of the loop fastening element 5 (see in particular FIG. 2 and FIG. 6). The second loop end 4*d* is fastened on a front side 29 of the loop fastening element 5 facing the direction of travel L by means of a fastening means 10 which is configured in the present exemplary embodiment as a screw. By forming a projection 24 running in the direction of travel L on the upper front edge of the loop fastening element 5, the second fastened loop end 4*d* is covered at the top toward the upper face of the head region 2*a* of the pole handle 1 and protected from environmental influences and the thickness of the loop material fastened in this region is compensated, so that the front surface of the loop fastening element is substantially flush. For guiding through the loop strap in order to form the loop portion 4*a*, the loop fastening element 5 has a through-opening 26 in the form of a slotted channel which is arranged substantially parallel to the bottom surface 35 of the loop fastening element 5, which with its longitudinal axis K2 in the non-tilted state or resting state of the loop fastening element 5 is substantially arranged along the longitudinal axis K1 of the head region of the pole handle. Both loop regions, which form the loop portion 4*a* for the hand, are guided through this through-opening 26, i.e. both the region for the fastened second loop end 4*a* and that for the free loop end 4*c*.

Figure 4:
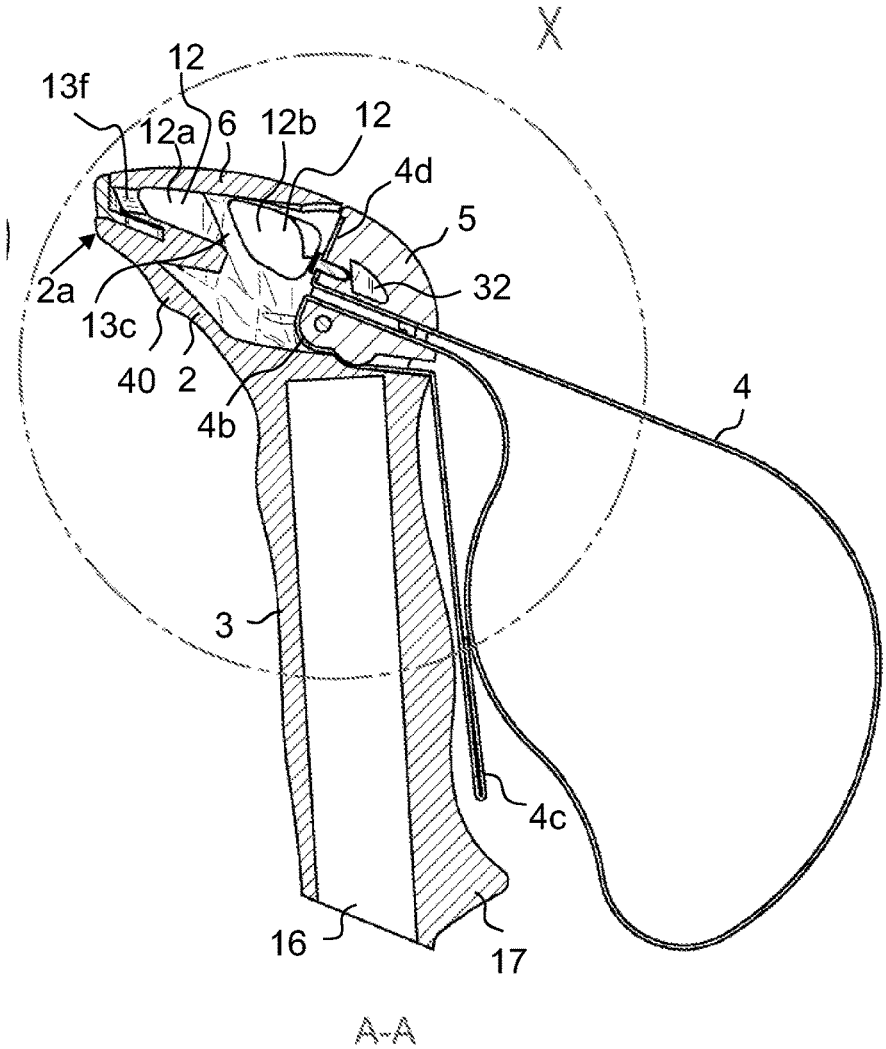
FIG. 4 shows an axial section X of the pole handle according to the first exemplary embodiment along the cutting plane A-A of FIG. 3.
Figure 5A:
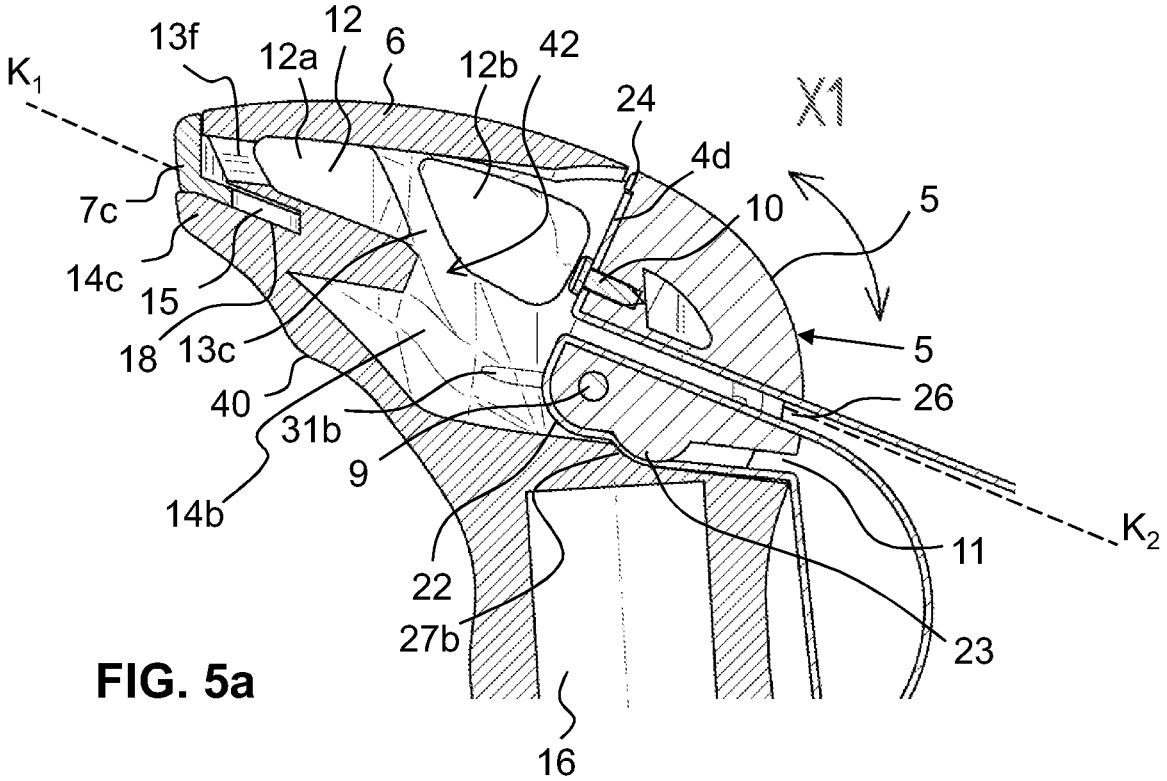
FIG. 5*a* and FIG. 5*b* show sections X of FIG. 4, in a) X1 with the fixed loop fastening element and a fixed loop length and in b) X2 with the loop fastening element tilted to the front and a longitudinally adjustable loop length.
Figure 5B:
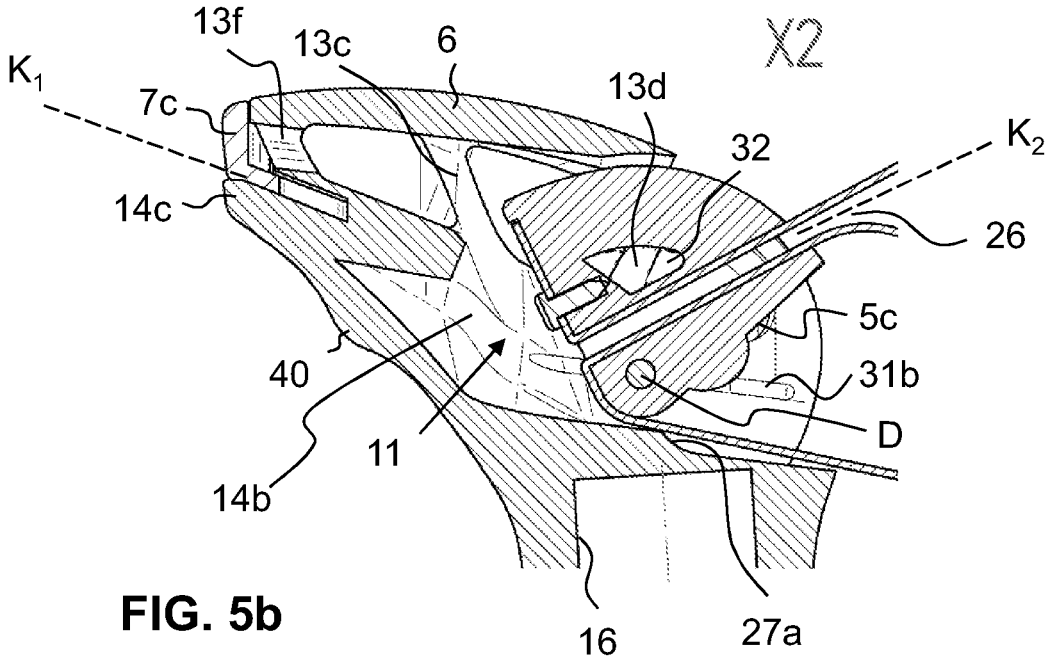

According to the first exemplary embodiment shown of FIGS. 1-14, the loop fastening element 5 is tiltably or pivotably arranged in the central handle head recess 11 about a rotational axis or tilt axis D about a pin 9 arranged in a through-opening 8, and namely between a resting position X1 as shown in FIG. 5*a*, and a tilted position X2 as shown in FIG. 5*b*. The pivoting region in this case is 30-40°. In the resting position the loop width is fixedly set, and in the tilted position of the loop fastening element 5 the loop width is adjustable, wherein the loop width in the latter position of the loop fastening element can be reduced by pulling on the first free end 4*a* of the hand loop, and can be increased by pulling on the part of the loop portion 4*a* facing the first free end.

In the resting position of the loop fastening element 5, the deflection portion 4*b* of the hand loop 4 is clamped between the base 27 of the handle head recess 11 and the lower face or the base 5*c* of the loop fastening element 5. The clamping is achieved here in a substantially similar manner to a labyrinth seal, in the form of a clamping portion 23 of the loop fastening element 5 which is configured as a projection 23 oriented downwardly toward the base 27 of the handle head recess 11. In addition to the frictional connection, to a certain extent there is also a positive connection via the one or optionally (more) clamping edge(s). The required clamping force for fixing the loop is significantly smaller due to the labyrinth edge than with a linear line of force, which permits an improved clamping action with the same clamping force or the same clamping action with a reduced clamping force. For this purpose, the base 27 of the handle head recess 11 has a clamping portion 27*a* which is configured as a step 37 by means of the edge 11*b*. In the resting state of the loop fastening element, the loop strap is clamped here between its deflection portion 4*b* and the first free loop portion 4*a*, protruding outwardly from the through-opening 26 of the loop fastening element 5 configured as a channel, by a frictional connection between the projection 23 and the stepped portion 27*b* of the base 27 of the handle head recess 11. As a result of the deflection of the free end of the loop strap, after passing through the through-opening 26 downwardly and to the rear around the loop fastening element, and which can be reinforced in a deflection region 22 (see FIG. 14) by corresponding transverse ribs or the like, the frictional connection is correspondingly reinforced by the clamping between the clamping projection 23 and the step 27*b*. The aforementioned clamping has the advantage that, in the case of a typical loading of the hand loop downwardly in one direction during use, the clamping is reinforced by the corresponding torque applied thereby (clockwise in the view according to FIG. 4).

As shown in FIG. 2, the loop fastening element 5 is a separately configured component which can be fastened to a "core body" or core 1*a* of the pole handle 1. The fastening takes place by a pin 9 which is introduced into a first through-opening 8*a* in the left-hand lateral wall of the pole handle 8*b*, is then guided through a through-opening 38 which extends through the loop fastening element 5 from a first left-hand lateral wall 5*a* of the loop fastening element 5 to a second right-hand lateral wall 5*b*, and is then guided through a second through-opening 8*b* in the right-hand lateral wall of the head region 2*a* of the pole handle 1. The longitudinal axis of the through-opening 38 or the longitudinal axis of the pin 9, with the inserted loop fastening element 5, is arranged substantially transversely to the pole handle longitudinal axis S and transversely to the direction of travel L.

In FIG. 14 the loop fastening element 5 or folding element is shown in detail. The loop fastening element 5 has a bulged top portion 25 which has a slightly protruding front edge 39 in the direction of travel. The top portion 25 or the upper face of the loop fastening element is incorporated in the upper face 6 of the pole handle 1 in the resting position and at the same time forms the rear region 2*b* of the head region 2 of the pole handle 1. The loop fastening element 5 is additionally captured by the engagement of the latching pins 7*e* and 7*f* (see FIG. 7*a*) into corresponding guide channels 28*a* and 28*b*.

In order to save weight, the loop fastening element can have recesses or windows 32, where a design consisting of solid material is not required when considering the load. Generally, the loop fastening element is preferably produced from a thermoplastic material, for example from polyamide, polypropylene, polyethylene, polycarbonate, in each case optionally (glass) fiber-reinforced, or mixtures of such materials.

In the resting state and when inserted in the pole handle recess 11, the loop fastening element 5 also has a lower face 37 oriented toward the base 27 of the central recess 11 of the pole handle 1. The loop fastening element 5 also has a first left-hand lateral surface 5*a* and a second right-hand lateral surface 5*b* which are arranged parallel to a plane E spanned by the handle head longitudinal axis K1 and the pole handle longitudinal axis S and extend parallel to the cutting plane A-A shown in FIG. 3.

In each case, a guide channel 28*a* or 28*b* which is curved according to the rotational movement of the loop fastening element is arranged both in the first left-hand lateral surface 5*a* and in the second right-hand lateral surface 5*b*, said guide channel extending parallel to the curvature of the top portion 25, and namely from the lower face 37 of the loop fastening element 5 (in this case an open groove) via a partial region of the respective lateral wall 5*a*, 5*b* and not completely as far as the front wall 29 of the loop fastening element 5. In addition to the aforementioned capture of the element, this respective guide channel 28*a*, 28*b* serves for the guidance of the loop fastening element 5 during the tilting process about the rotational or tilt axis 9 or about the pin 9. This guidance is achieved by the two above-described lateral, also correspondingly curved, latching pins 7*e*, 7*f* of the attachment 7 engaging or latching into these two guide channels 28*a*, 28*b*. This latching connection between the loop fastening element 5 and the attachment 7 connects the attachment 7 to the loop fastening element 5 and at the same time also indirectly connects the attachment to the core 1*a* of the pole handle 1 via the loop fastening element 5. The latching connection thus provides at the same time a guide function for the rotation of the loop fastening element between the latching position and the adjustment position, and a protection against loss for the attachment 7 on the core 1*a* of the pole handle 1.

In each case, a latching channel 33*a*, 33*b* is arranged in both lateral surfaces 5*a*, 5*b* of the loop fastening element 5, in each case a latching cam 31*a*, 31*b* oriented inwardly from the lateral wall 14*a*, 14*b* of the core 1*a* engaging therein in the resting position, i.e. in the untilted position of the loop fastening element 5. In this case, the latching channels 30*a*, 30*b* run in each case substantially parallel to the bottom surface 37 of the loop fastening element 5.

The latching cams 31*a*, 31*b* run substantially parallel to the base 27 of the central recess 11 of the core 1*a*.

Additionally, each lateral wall 5*a*, 5*b* of the loop fastening element 5 respectively has a further latching channel 33*a*, 33*b* which intersects the first or the second latching channel 30*a*, 30*b* at an acute angle. The point of intersection of the first latching channel 30*a* with the third latching channel 33*c* in the first lateral wall 5*a* of the loop fastening element 5 and the point of intersection of the second latching channel 30*b* with the fourth latching channel 33*d* in the second lateral wall 5*b* of the loop fastening element 5 is defined by the through-opening 38 in the loop fastening element 5 or by the receiving channel for the transverse pin 9 for the tiltable connection of the loop fastening element 5 on the pole handle core 1*a*. Thus, in the untilted resting state according to FIG. 5*a*, the loop fastening element 5 is latched with its first and second latching channel 30*a*, 30*b* in the two opposing latching cams 31*a*, 31*b* in the core 1*a*, which for example can be identified in FIG. 6 on the second lateral wall 14*b* of the core 1*a*. In order to tilt the loop fastening element 5 to the front for the purpose of adjusting the diameter of the hand loop, the loop portion 4*a* of the hand loop 4 is pulled upwardly. When the loop fastening element 5 is tilted to the front about the rotational axis/tilt axis or about the transverse pin 9, the latching cams 31*a*, 31*b* are pushed out of the respective corresponding first and second latching channel 30*a*, 30*b* and thus this latching connection is released, wherein in the tilted state according to FIG. 5*b*, the latching cams 31*a*, 31*b* engage in the third or fourth latching channel 33*a*, 33*b* and thus a further latching connection is created. The latching and release of the latching results, on the one hand, in a simple positive fixing of the respective position but, on the other hand, also in a haptic and optionally also acoustic feedback for the user.

Furthermore, when the loop fastening element 5 is tilted or pivoted, the clamping region 23 of the loop fastening element 5 is lifted away from the stepped portion 27*a*. During the tilting process, the projection 24 on the top portion 25 of the loop fastening element 5 is additionally pivoted into the central recess 11 of the head region 2.

The loop fastening element 5 also has a front surface 29 which is oriented in the direction of travel L, the surface thereof extending at an angle which is less than 90° to the bottom surface 27 of the loop fastening element 5. A recess 10*a* is arranged substantially centrally in this front surface 29, said recess serving for receiving a fastening means 10 for the second loop end 4*d*. In the exemplary embodiment shown of FIG. 2, or FIGS. 5*a*, 5*b*, this fastening means is configured as a screw. In this case, however, a rivet, a pin, an adhesively bonded connection, an eye in the hand loop with a hook, or a combination of such fastening means can also be used.

If the loop fastening element 5 is replaced, or this loop fastening element is dismantled for the replacement of the hand loop, for example, either the attachment 7 can be initially removed from the core 1*a* and from the loop fastening element 5, i.e. the latching connection between the latching pins 7*e*, 7*f* on the arms 7*a*, 7*b* of the attachment 7 and the loop fastening element 5 can be released by spreading apart the arms 7*a*, 7*b*. Due to this spreading apart, the latching connection is also released between the latching tongue 34 of the core 1*a* and the latching lugs 7*g*, 7*h* on the base 7*d* of the attachment 7. Then (or even before) the transverse pin 9 can be pushed out of the through-opening 8*a* in the loop fastening element 5 and from the through-opening 8 below the head region 2 of the core 1*a*, for example by means of a pin of smaller diameter. By pulling the loop fastening element to the rear along the latching cam 31*a*, 31*b*, the loop fastening element 5 can be removed from the central recess 11 of the core 1*a*.

Alternatively, the transverse pin 9 can be initially pushed out of the through-opening 8*a* in the loop fastening element 5 and from the through-opening 8 below the head region 2 of the core 1*a*, for example by means of a pin of smaller diameter. Then the loop fastening element 5 can be removed out of the central recess 11 of the core 1*a*, simply by spreading apart the arms 7*a*, 7*b* and by pulling the loop fastening element 5 upwardly or to the rear. Then the attachment 7 is removed from the core 1*a*, i.e. the latching connection is released between the latching pins 7*e*, 7*f* on the arms 7*a*, 7*b* of the attachment 7.

For the assembly of the pole handle 1 during manufacture, or after replacing or repairing the loop fastening element 5 or the hand loop 4, either the loop fastening element 5 is initially inserted into the central recess 11 of the handle head 2 of the pole handle 1 substantially from the rear along the longitudinal axis K1 of the head region 2 and along the latching cams 31*a*, 31*b* and fastened by means of the transverse pin 9 to the core 1*a* of the pole handle 1, as described above, and then the attachment 7 is pushed from the front onto the core 1*a* of the pole handle 1, for the further indirect connection of the loop fastening element to the core 1*a* of the pole handle 1. Alternatively, in the reverse sequence, the attachment is initially positioned and then the loop fastening element 5 is inserted and fastened in the central recess 11 of the handle head 2 of the pole handle 1.

Figure 15:
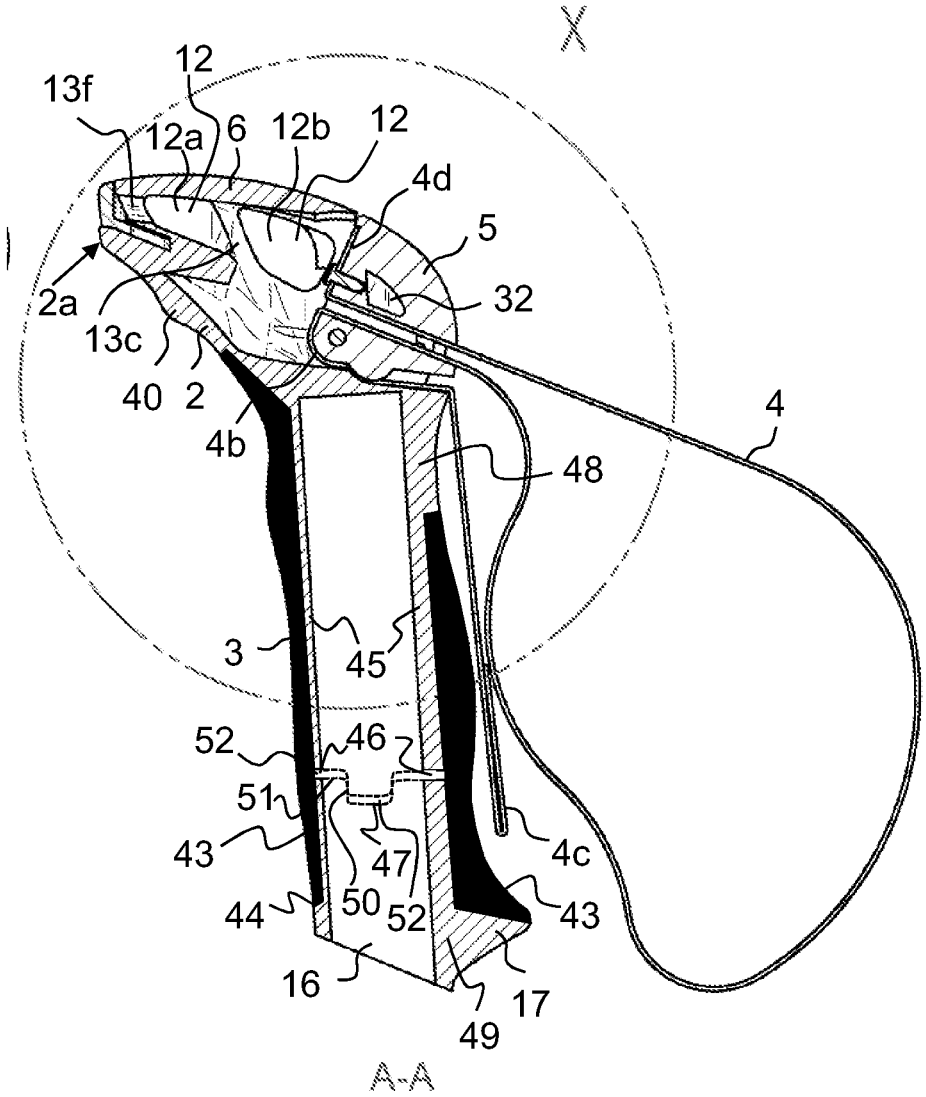
FIG. 15 shows an axial section X of the pole handle according to the first exemplary embodiment along the cutting plane A-A of FIG. 3, wherein a casing made of a cork material or foam material is arranged in the handle region.

In FIG. 15 a variant of the handle according to FIG. 4 is shown. In this case, the handle has in the handle region a peripheral casing 43 made of a cork material or a foam material (for example EVA). The casing 43 in this case is introduced into a peripheral recess 44 in the actual region 45 of the hard core material which forms the handle. The casing 43 in this case terminates flush with the contour of the handle over the entire edge. As a result, a construction which is particularly easy to grip and which is also lightweight is ensured. So that such a construction can be easily assembled, the cylindrical region 45 of the hard core material 3 has a peripheral slot 46, i.e. the handle is configured approximately in two parts relative to the hard core material, namely there is an upper region 48 with the head region 2 and the upper part of the region which forms the axial recess 16, and a lower part 49 which, for example, comprises the shoulder 17 and the lower part of the region which forms the axial recess 16.

Advantageously, the slot 46, as shown in the figure in dashed lines, is designed with a meandering path 47, in particular so that to a certain extent an anti-rotation device is ensured and to a certain extent also a positive connection or even a non-positive connection can be provided between the upper and the lower part. In a preferred variant, the meandering slot 46 has longitudinal portions 50 of the edges which run along the axis of the pole, and transverse portions 51 of the edges which run in the peripheral direction and perpendicular to the axis of the pole. Preferably, the longitudinal edges of the meandering slot from the upper part and the lower part are joined virtually without play or even slidably in abutment, or specifically even in frictional contact against one another with a frictional connection, in order to achieve as far as possible an exact orientation of the two handle parts relative to rotation about the pole axis. In a further advantageous manner, when the casing is assembled, the meandering slot forms with the transverse edges 51 in its transverse path relative to the pole axis a spacing 52 between the front-side contact surfaces of the two sleeve portions of the handle parts. This avoids a redundancy of the handle parts. This design of the slot is advantageous, irrespective of the further features of the exemplary embodiment which is used here for illustration, and is to be regarded as being in accordance with the invention.

Such a handle head is assembled by the upper region 48 being pre-positioned, then the casing 43 being pushed from below onto the cylindrical region 45, and then the lower region 49 being pushed from below into the exposed lower opening in the casing 43. The parts are connected together by adhesive being provided between the casing and the upper region 48 and the lower region 49, and connecting means can also be provided between the upper region 48 and the lower region 49. Since this region is ultimately fixed by the inserted pole tube, it can be sufficient if an adhesive connection is provided of the respective region 48/49 on the casing 43. Similarly, the elastomer region, already mentioned above, can also be arranged on the lower face of the handle head in the region of the elevation 40 in a corresponding recess in the hard core material. Typically, however, such an elastomer region is not manufactured as a separate component but, in a simpler manner, injection-molded in a two-component method onto the hard core material at the same time.

LIST OF REFERENCE SIGNS

| | |
|---|---|
| 1 | Pole handle, handle body |
| 1a | Core of 1a, body |
| 2 | Head region |
| 2a | Front region, handle nose of 2 |
| 2b | Rear region of 2 |
| 3 | Handle region |
| 4 | Hand loop |
| 4a | Loop portion |
| 4b | Deflection portion |
| 4c | Free first loop end |
| 4d | Fastened second loop end |
| 5 | Loop fastening element/block |
| 5a | Left-hand first lateral surface of 5 |
| 5b | Right-hand second lateral surface of 5 |
| 5c | Lower face/base of 5 |
| 6 | Upper face/top surface of 1a or of 2 |
| 7 | Cover element/attachment element |
| 7a | Left-hand first arm of 7 |
| 7b | Right-hand second arm of 7 |
| 7c | Front wall of 7 |
| 7d | Base of 7 |
| 7e | First latching pin on 7a |
| 7f | Second latching pin on 7b |
| 7g | Recess of 7 |
| 7h | Left-hand first lug on 7g in 7d |
| 7i | Right-hand second lug on 7g in 7d |
| 7k | Slotted extension of 7g |
| 7m | Interior of 7 |
| 8 | Through-opening in 3 for 9 |
| 9 | Pin of 5 |
| 10 | Fastening means for 4d |
| 10a | Recess in 5 for 10 |
| 11 | Central recess in 2 |
| 12 | Through-hole surface |
| 12a | First through-hole in 14a |
| 12b | Second through-hole in 14a |
| 12c | Third through-hole in 14a |
| 12d | Fourth through-hole in 14b |
| 12e | Fifth through-hole in 14b |
| 12f | Sixth through-hole in 14b |
| 13a | First web of 1a in 2/14a |
| 13b | Second web of 1a in 2/14a |
| 13c | Third web of 1a in 2/14b |
| 13d | Fourth web of 1a in 2/14b |
| 13e | Left-hand foremost web in 14a |
| 13f | Right-hand foremost web in 14b |
| 14a | Left-hand first lateral wall of 1a on 2 |
| 14b | Right-hand second lateral wall of 1a on 2 |
| 14c | Front wall of 1a in 2a |
| 15 | Fifth through-hole in 14c |
| 16 | Axial recess in 3 |
| 17 | Shoulder on 3 |
| 18 | Slot in 2a |
| 19 | First protrusion in 6 |
| 20 | Second protrusion |
| 21 | Shoulder on 2 |
| 22 | Deflection region of 5 |
| 23 | Clamping region of 5 |
| 24 | Projection of 5 |
| 25 | Top portion of 5 |
| 26 | Through-opening of 5 |

-continued

| | |
|---|---|
| 27 | Base of 11 |
| 27a | Step, clamping portion of 27 |
| 27b | Edge of 27 |
| 28a | Guide channel for 7e |
| 28b | Guide channel for 7f |
| 29 | Front wall of 5 |
| 30a | First latching channel on 5a |
| 30b | Second latching channel on 5b |
| 31a | First latching cam of 14a in 11 |
| 31b | Second latching cam of 14b in 11 |
| 32 | Window in 5 |
| 33a | Third latching channel on 5a |
| 33b | Fourth latching channel on 5b |
| 34 | Latching tongue on 35 for 7g |
| 35 | Latching structure |
| 37 | Lower face of 5 |
| 38 | Through-opening of 5, receiving channel for 9 in 5 |
| 39 | Front edge of 25 |
| 40 | Elevation below 2 |
| 41 | Arcuate web |
| 42 | Hollow space |
| 43 | Cork or foam casing |
| 44 | Peripheral recess in hard core material |
| 45 | Cylindrical region of hard core material of 3 |
| 46 | Peripheral slot in 45, parting line |
| 47 | Meandering path of 46 |
| 48 | Upper region of hard core material |
| 49 | Lower region of hard core material |
| 50 | Longitudinal edges of slot 46 |
| 51 | Transverse edges of slot 46 |
| 52 | Spacing between 51 of upper part and lower part |
| 53 | Pole |
| α | Angle between K1 and S |
| D | Rotational axis for 5 |
| E | Plane spanned by handle head longitudinal axis K1 and pole handle longitudinal axis S |
| K1 | Longitudinal axis of 2a, longitudinal axis of 26 in resting position of 5 |
| K2 | Longitudinal axis of 26 in adjustment position of 5 |
| L | Direction of travel |
| S | Pole handle longitudinal axis |
| U | Peripheral direction of 1 |
| X1 | Resting position, position in which the length of the hand loop cannot be adjusted |
| X2 | Adjustment position, position in which the length of the hand loop can be adjusted |

The invention claimed is:

1. A pole handle, having a head region and a handle region, as well as an axial recess for receiving a pole tube and a hand loop which is fastened thereto and which is adjustable in terms of its size, wherein the pole handle has a central recess in which a loop fastening element with said hand loop, which is fastened to the loop fastening element and which is adjustable in terms of its size, is at least partially received, wherein the loop fastening element and the hand loop, which is fastened to the loop fastening element, form a modular unit which is configured separately from a core of the pole handle and which is fastened to the core of the pole handle in a reversibly tiltable manner about a rotational axis in the pole handle, wherein the loop fastening element can be tilted from a resting position, in which the loop fastening element is integrated in the surface contour of the handle head and in which the size of the hand loop cannot be adjusted, upwardly about the rotational axis into an adjustment position, and in this adjustment position the size of the hand loop can be adjusted.

2. The pole handle as claimed in claim 1, wherein the loop fastening element has a through-opening through which the loop strap of the hand loop is guided out of the pole handle, is guided around the hand of the user, and passes again through the loop fastening element, through the same through-opening with the free end.

3. The pole handle as claimed in claim 2, wherein in the resting position the loop strap is fixedly clamped between a lower face of the loop fastening element and an opposing base of the central recess.

4. The pole handle as claimed in claim 2, wherein the free end of the loop strap is guided downwardly to the rear of this through-opening around the loop fastening element around a deflection region, and is then guided out of the handle head below the loop as a free loop end.

5. The pole handle as claimed in claim 3, wherein means are arranged in the clamping region and/or in the deflection region in order to prevent the adjustment of the size of the hand loop.

6. Pole handle as claimed in claim 5, wherein the means are configured at least partially in the form of one or more clamping projections or clamping protrusions and/or corresponding recesses, steps or grooves in the mating surface or wherein at least one rib running transversely to the direction of travel is arranged on the lower face of the loop fastening element and a corresponding step is arranged in the opposing base of the central recess.

7. The pole handle as claimed in claim 1, wherein the loop fastening element is tiltably fastened on the core of the pole handle by means of a transverse pin arranged along the rotational axis transversely to a direction of travel and transversely to the pole handle longitudinal axis in a through-opening of the core of the pole handle.

8. The pole handle as claimed in claim 1, wherein the loop fastening element is additionally fastened by means of a direct or indirect connection to the core of the pole handle.

9. The pole handle as claimed in claim 8, wherein said connection is providing at the same time a guide function for the tilting movement between the resting position and the fixed position or wherein projections are provided therefor on the core and/or on a separate element, said projections engaging at least partially in curved recesses in the lateral surfaces.

10. The pole handle as claimed in claim 1, wherein latching elements which permit the loop fastening element to be latched in the resting position and/or in the adjustment position are provided.

11. The pole handle as claimed in claim 10, wherein the loop fastening element has at least one first latching channel in at least one lateral surface in which at least one first latching cam engages in the resting state, wherein the loop fastening element has two latching channels which are arranged on two lateral walls of the loop fastening element, which are arranged parallel to one another and opposing one another, and wherein the core has two latching cams which are oriented inwardly into the central recess and which are arranged on two lateral walls of the core, which are arranged substantially parallel to one another and opposing one another, and which engage in the two latching channels, or wherein the loop fastening element has at least one second latching channel in at least one lateral surface in which at least one first latching cam engages in the adjustment position, wherein the loop fastening element has two latching channels which are arranged on two lateral walls of the loop fastening element, which are arranged parallel to one another and opposing one another, and wherein the core has two latching cams which are oriented inwardly into the central recess and which are arranged on two lateral walls of the core, which are arranged substantially parallel to one another and opposing one another, and which engage in the two latching channels.

12. The pole handle as claimed in claim 1, wherein the hand loop has a loop portion for circulating around the hand of the user, and a deflection portion which adjoins the loop portion on one side, which is inserted into a slotted through-opening of the loop fastening element, and which is guided downwardly in the central recess around a deflection region of the loop fastening element, and a first free end which protrudes from the central recess and which adjoins the deflection portion, wherein the hand loop additionally has a second end which adjoins the peripheral loop portion and which is fastened to the loop fastening element.

13. The pole handle as claimed in claim 1, wherein the loop fastening element has at least one recess, or wherein the loop fastening element has means which ensure a seal on its front surface in the transition to the top portion, forming the surface of the handle head during use in the resting position.

14. The pole handle as claimed in claim 1, wherein the pole handle has at least one attachment which is positively and releasably connected to the loop fastening element and/or to the core.

15. The pole handle as claimed in claim 14, wherein the at least one attachment is positively and releasably connected to the core of the pole handle.

16. The pole handle as claimed in claim 14, wherein the pole handle has a first positive connection between the core and the loop fastening element, as well as a second positive connection between the loop fastening element and the at least one attachment and a third positive connection between the core and the at least one attachment.

17. The pole handle as claimed in claim 14, wherein the at least one attachment is positively and releasably connected to the core of the pole handle, by means of at least one latching connection.

18. The pole handle as claimed in claim 1, wherein the angle between the resting position and the adjustment position ranges from 20-90°.

19. The pole handle as claimed in claim 1, wherein the loop fastening element has a curved top portion which in the fixed position is integrated at least partially, or entirely, in an external contour of the top region.

20. A method for the assembly of a pole handle as claimed in claim 1, comprising a step of fastening the hand loop with a free end to the loop fastening element, followed by a step of inserting the loop fastening elemen as a module into the central recess and a step of tiltably fastening the loop fastening element via a transverse pin in the central recess in the handle head.

21. The method for the assembly of a pole handle as claimed in claim 20, wherein before or subsequently to the step of tiltably fastening the loop fastening element via a transverse pin in the central recess in the handle head, at least one attachment is pushed on and fastened to the handle head, in a self-latching manner, and the loop fastening element is additionally secured via this attachment, respectively regions thereof, to the handle head and is additionally guided for the tilting movement.

22. A pole having a pole handle as claimed in claim 1.

23. The pole according to claim 22, wherein it is a trekking pole, ski pole, cross-country ski pole or Nordic walking pole.

24. The pole handle as claimed in claim 1, wherein it is for a ski pole, cross-country ski pole, trekking pole or Nordic walking pole.

25. The pole handle as claimed in claim 1, wherein the hand loop has a loop portion for circulating around the hand of the user, and a deflection portion which adjoins the loop portion on one side, which is inserted into a slotted through-opening of the loop fastening element, and which is guided downwardly in the central recess around a deflection region of the loop fastening element, and a first free end which protrudes from the central recess and which adjoins the deflection portion, wherein the hand loop additionally has a second end which adjoins the peripheral loop portion and which is fastened to the loop fastening element, on a front wall of the loop fastening element which is arranged in the central recess of the pole handle, by means of a fastening means which is a screw, a pin, a rivet, a hook, a material connection, including an adhesive connection, welded connection, injection-molding or a combination thereof.

26. The pole handle as claimed in claim 1, wherein the loop fastening element has at least one recess which is arranged transversely to the direction of travel.

27. The pole handle as claimed in claim 1, wherein the pole handle has at least one, clamp-shaped, attachment which is positively and releasably connected to the loop fastening element and/or to the core, wherein the attachment has two lateral walls which converge in a front wall in the direction of travel and which are connected downwardly by a base in a front region, wherein the lateral walls in each case have a free end which is oriented to the rear counter to the direction of travel and on which in each case a latching pin is arranged, and wherein the latching pins engage in each case in a curved guide channel which is arranged on opposing lateral walls of the loop fastening element, whereby during a tilting movement of the loop fastening element the loop fastening element is guided in the central recess of the pole handle, and wherein the at least one guide channel is configured along the curvature of a top portion of the loop fastening element.

28. The pole handle as claimed in claim 1, wherein the angle between the resting position and the adjustment position ranges from 30-80°.

29. The pole handle as claimed in claim 1, wherein the angle between the resting position and the adjustment position ranges from 45-70°.

* * * * *